US007726759B2

(12) United States Patent
Takata

(10) Patent No.: US 7,726,759 B2
(45) Date of Patent: Jun. 1, 2010

(54) IMAGE FORMING APPARATUS

(75) Inventor: Takuya Takata, Kanagawa (JP)

(73) Assignee: Fujifilm Corporation, Toyko (JP)

( * ) Notice: Subject to any disclaimer, the term of this patent is extended or adjusted under 35 U.S.C. 154(b) by 283 days.

(21) Appl. No.: 11/356,349

(22) Filed: Feb. 17, 2006

(65) Prior Publication Data

US 2006/0187250 A1 Aug. 24, 2006

(30) Foreign Application Priority Data

Feb. 21, 2005 (JP) ..... 2005-044320

(51) Int. Cl.
*B41J 29/38* (2006.01)

(52) U.S. Cl. ..... 347/13; 347/10; 347/12; 347/14; 347/19

(58) Field of Classification Search ..... None
See application file for complete search history.

(56) References Cited

U.S. PATENT DOCUMENTS

| | | | | |
|---|---|---|---|---|
| 6,193,346 | B1 | 2/2001 | Nakano | |
| 6,357,846 | B1 | 3/2002 | Kitahara | |
| 6,619,777 | B2 | 9/2003 | Chang | |
| 2002/0167560 | A1* | 11/2002 | Fujimori | 347/15 |
| 2004/0125159 | A1 | 7/2004 | Usuda et al. | |

FOREIGN PATENT DOCUMENTS

| | | | |
|---|---|---|---|
| JP | 11-91143 | A | 4/1999 |
| JP | 11-221921 | A | 8/1999 |
| JP | 11-320872 | A | 11/1999 |
| JP | 2000-37867 | A | 2/2000 |
| JP | 2002-59543 | A | 2/2002 |
| JP | 2002-154207 | A | 5/2002 |
| JP | 2004-122120 | A | 4/2004 |

* cited by examiner

*Primary Examiner*—Matthew Luu
*Assistant Examiner*—Justin Seo
(74) *Attorney, Agent, or Firm*—Birch, Stewart, Kolasch, & Birch, LLP.

(57) ABSTRACT

The image forming apparatus comprises: a liquid ejection head which has a plurality of nozzles and a plurality of pressure generating elements corresponding to the nozzles, and applies a drive signal to the pressure generating elements so as to eject recording liquid from the nozzles; a plurality of drive waveform generating circuits which generate the drive signal having waveform for driving the pressure generating elements; a plurality of dummy capacitive loads which are connected to the drive waveform generating circuits; and a circuit selection device which selects at least one of the drive waveform generating circuits for applying the drive signal to at least one of the pressure generating elements and the dummy capacitive loads.

11 Claims, 24 Drawing Sheets

116
112
120
150
Enable
Select
146-a1
146-b1
146-a2
146-b2
OUTb1
151(cd1)
OUTa1
OUTa2
OUTb2
OUTan
OUTbm
58
(Cp1)
(Cpn)
(Cdm')
146
130A
152A
154A
155A
156A
COM1
CLK1
130B
152B
154B
155B
156B
COM2
CLK2
130C
152C
154C
155C
156C
COM3
CLK3
130D
152D
154D
155D
156D
COM4
CLK4
HEAD CONTROLLER
PRINT SERIAL DATA SD
CLOCK CLK
LATCH SIGNAL LAT
SHIFT REGISTER
LATCH CIRCUIT
LEVEL CONVERSION CIRCUIT
140
142
144
146-an
146-bm'

120-1
50
Enable
Select
146-a11
146-1
146-a12
130A
COM1(COM11)
OUTa1
OUTb1
58
(Cp1)
130B
COM2
(COM12)
151
(Cd1)
HEAD CONTROLLER
130C
COM3
(COM13)
(Cp2)
130D
COM4
(COM14)
(Cd2)
120-k
Enable
Select
146-k
116
112
COM1(COMk1)
COM2
(COMk2)
OUTan
COM3
(COMk3)
(Cpn)
OUTbm
COM4
(COMk4)
(Cdm)
146-b4m

IMAGE FORMING APPARATUS

BACKGROUND OF THE INVENTION

1. Field of the Invention

The present invention relates to an image forming apparatus, and more particularly, to an image forming apparatus which carries out printing by using a liquid ejection head having pressure generating elements corresponding to a plurality of ejection ports (nozzles), and to drive control technology for a liquid ejection head suitable for the image forming apparatus.

2. Description of the Related Art

In general, in an inkjet type recording apparatus (inkjet printer), ink droplets are ejected at prescribed timings from the nozzles of the recording head, on the basis of the dot pattern data (also called "dot data" or "print data") expanded from image data for printing which has been input from a host computer. Printing is carried out by means of these ink droplets landing on and adhering to a print recording medium, such as a piece of recording paper.

As a system of the recording head, for example, a system where ink droplets are ejected by causing change in the volume of pressure chambers (pressure generating chambers) connected to nozzle apertures, is known. In a recording head of this kind, a diaphragm which is elastically deformable in the outward direction is formed on a portion of the circumferential walls which demarcate the pressure chambers, and the volume of the pressure chambers is changed by causing this diaphragm to vibrate by means of pressure generating elements typified by piezoelectric elements.

Generally, a plurality of nozzle apertures are formed in the recording head, and a pressure chamber and a piezoelectric element are provided for each one of the plurality of nozzle apertures. All of the piezoelectric elements are electrically connected in parallel between a common power supply and ground wire, and a switching element is electrically connected in series with each of the piezoelectric elements. A signal (which is also referred to as "drive waveform" or "waveform") for driving the piezoelectric elements is generated by a drive waveform generating circuit, and it is selectively distributed and supplied to the piezoelectric elements via the power supply line and the switching elements.

More specifically, if a prescribed switching element, such as a switching array or analogue switch is selected and switched on according to the print data, for example, then a drive waveform is applied to a piezoelectric element via the power supply line, and an ink droplet is ejected from a prescribed nozzle aperture corresponding to the piezoelectric element to which the drive waveform has been applied.

In an inkjet recording apparatus which uses piezoelectric elements as described above, a common drive circuit system is generally adopted. In the common drive circuit system, one common drive waveform formed by combining a plurality of drive waveform elements for ejecting a plurality of types of ink droplets of different ink volumes (for example, a large dots, a medium dot, and a small dot) is used, and the required waveform portion is selectively applied to each of the piezoelectric elements by means of switches (see Japanese Patent Application Publication Nos. 2002-154207 and 2000-37867). In this system, there is no need to prepare drive waveform generating circuits individually for each of the piezoelectric elements because the common drive waveform is simultaneously applied to a plurality of piezoelectric elements. Therefore, this system has benefit in that the number of analogue circuits for high-voltage and high-precision, and the number of wires, can be reduced.

On the other hand, in view of the object of increasing printing speed and the like, in recent years, array type and line type printers have been proposed, in which a very large number of nozzles are prepared, ink being simultaneously ejected from the large number of nozzles in such a manner that printing is carried out quickly. In an array type or line type recording head having a large number of nozzles, if the common drive circuit system described above is used without modification, then a large number of piezoelectric elements are simultaneously driven according to drive waveforms output from a single drive circuit, the drive waveform is distorted by the load fluctuation, ejection errors may arise, and consequently non-uniformities in image quality may occur.

Various methods have been proposed in view of these. For example, a method where a dummy load element having an electrostatic capacitance (for example, several hundred nanofarads (nF) for approximately 1000 elements (nozzles)), which exceeds the electrostatic load capacitance of the piezoelectric elements ("several hundred picofarads (pF) per element" multiplied by "the number of elements") is provided (connected) either before or after the power supply line (signal wire), a method where various feed back controls based on a circuit (hardware) are applied to the drive circuit, a method where various feed back controls based on a software are applied to the drive circuit, and the like.

FIG. 24 shows the principal composition of the circuit required for head driving on the basis of the related art technology. As shown in FIG. 24, a ceramic capacitor 502 forming a dummy load element is provided before the flexible substrate 500 forming the power supply line, and a ceramic capacitor 504 forming a dummy load element is provided after the flexible substrate 500. At least one of the ceramic capacitors 502 and 504 should be connected to the flexible substrate 500.

Furthermore, as an example of providing to a signal line a dummy load element having a larger capacitance than the load capacitance of the piezoelectric element, there is a method in which each head is driven by selecting and adjusting the dummy load element for each head, in order to operate a plurality of heads having piezoelectric elements with different specifications in the same apparatus, as described in Japanese Patent Application Publication No. 2004-122120. The time constant $\tau$ which is a factor that flattens the drive signal, can be expressed as $\tau=C\times R$, on the basis of the electrostatic capacitance component C of the piezoelectric element, and the resistance component R, such as the wiring resistance, on resistance of analog switch. A method where the electrostatic capacitance component C and the resistance component R are adjusted in such a manner that this time constant $\tau$ is uniform, is known.

Furthermore, as an example of applying a circuit-based feedback to the drive circuit, there is a method where the feedback method is adjusted and a dummy load element is prepared in the piezoelectric element connection sections, in such a manner that variation in the on-resistance of the analog switches can also be adjusted, as described in Japanese Patent Application Publication No. 2002-59543. As an example of applying control-based feedback to the drive circuit, there is a method where the capacitance value of the required load is monitored, a dummy load element is selected on the basis of the monitoring results, and the capacitance of the dummy load element is determined in such a manner that the sum of the capacitance load and the dummy load is constant, as described in Japanese Patent Application Publication No. 11-320872.

However, in a print head having a plurality of nozzles exceeding 1000 nozzles, such as an array or line type of print head which ejects ink substantially simultaneously from the large number of nozzles in order to perform high-speed recording, a plurality of drive circuits constituted by common drive circuit systems need to be prepared. In this system, it is necessary to provide each of the drive circuits with a dummy load element, and hence the circuits may become large in size and the installation may become difficult. In addition to this, it is necessary to adjust the drive circuits in such a manner that the standards of the electrostatic capacitance value of the drive circuits are different from each other. For example, if a situation occurs where the electrostatic capacitance relating to ejection is low and the dummy load is high in a certain drive circuit and the electrostatic capacitance relating to ejection is high and the dummy load is low in another drive circuit, then some dummy loads are redundantly driven and there is an insufficiency in the electrostatic capacitance of the dummy loads used. As a result of that, power is wastefully consumed in the drive circuits (the power consumption in the drive circuits gets increase).

Specifically, if not only a large number of piezoelectric elements but also dummy load elements are simultaneously driven, then the drive circuit instantaneously consumes a large amount of power. Therefore, a voltage drop may occur in the power supply. In order to avoid the voltage drop of this kind in the power supply and to drive the piezoelectric elements reliably, it is necessary to provide a power supply apparatus having a large power supply capacity.

Furthermore, if a large amount of energy is consumed by the drive circuit and the drive energy is insufficient, then ink ejection may become unstable, and quality deterioration may arise in the recorded image.

SUMMARY OF THE INVENTION

The present invention has been contrived in view of the foregoing circumstances, and an object thereof is to provide an image forming apparatus which maintains print quality while a large number of nozzles are simultaneously driven, reduces overload on the drive circuit, reduces non-uniformities in image quality caused by waveform distortion between the drive circuits, and thereby improves image quality. Another object of the present invention is to provide an image forming apparatus which makes it possible to reduce the circuit size and to reduce the power supply capacity.

In order to attain the aforementioned object, the present invention is directed to an image forming apparatus, comprising: a liquid ejection head which has a plurality of nozzles and a plurality of pressure generating elements corresponding to the nozzles, and applies a drive signal to the pressure generating elements so as to eject recording liquid from the nozzles; a plurality of drive waveform generating circuits which generate the drive signal having waveform for driving the pressure generating elements; a plurality of dummy capacitive loads which are connected to the drive waveform generating circuits; and a circuit selection device which selects at least one of the drive waveform generating circuits for applying the drive signal to at least one of the pressure generating elements and the dummy capacitive loads.

According to this aspect of the present invention, a plurality of dummy capacitive loads are connected to the drive waveform generating circuits via the circuit selection device. Therefore, it is possible to connect the plurality of dummy capacitive loads to the drive waveform generating circuits selectively (i.e., in a selective fashion).

The "pressure generating element" of the present invention includes an example using a piezoelectric element, or other actuator, which changes the volume of a liquid chamber (pressure chamber) in which recording liquid is accommodated, for example.

Furthermore, the drive signal supplied to the pressure generating elements from the drive waveform generating circuits may also include an example in which common drive waveforms including a plurality of ejection waveform components for ejecting a plurality of types of liquid droplets of different volumes are generated.

Ceramic capacitors, or the like, are suitable for use as the dummy capacitive loads. Furthermore, if a liquid ejection head provided with pressure generating elements, and the drive waveform generating circuits are connected by wiring members, then the dummy capacitive loads may be provided on the liquid ejection head side, or they may be provided on the drive waveform generating circuit side. If the dummy capacitive loads are provided in the liquid ejection head, then the same elements as the pressure generating elements (for example, piezoelectric elements) may be used for the dummy capacitive loads.

The plurality of dummy capacitive loads may also include loads having different electrostatic capacitances. The plurality of dummy capacitive loads may also be constituted by elements having substantially the same capacitance.

A compositional example of the "liquid ejection head" according to the present invention is a full line type inkjet head having a nozzle row in which a plurality of nozzles for ejecting ink are arranged through a length corresponding to the full width of the recording medium.

In this case, an example may be adopted in which a plurality of relatively short ejection head blocks having nozzle rows which do not reach a length corresponding to the full width of the recording medium are combined and joined together, thereby forming long nozzle rows that correspond to the full width of the recording medium.

A full line type inkjet head is usually disposed in a direction that is relatively perpendicular to the feed direction (relative conveyance direction) of the recording medium. An example may also be adopted in which the inkjet head is disposed following an oblique direction that forms a prescribed angle with respect to the direction perpendicular to the conveyance direction.

"Recording medium" indicates a medium on which an image is recorded by means of the action of the liquid ejection head (this medium may also be called an ejection receiving medium, print medium, image forming medium, image receiving medium, or the like). This term includes various types of media, irrespective of material and size, such as continuous paper, cut paper, sealed paper, resin sheets such as OHP sheets, film, cloth, a printed circuit board on which a wiring pattern or the like is formed, an intermediate transfer medium, and the like.

The conveyance device for causing the recording medium and the liquid ejection head to move relatively to each other, may include an example where the recording medium is conveyed with respect to a stationary (fixed) liquid ejection head, an example where a liquid ejection head is moved with respect to a stationary recording medium, or an example where both the liquid ejection head and the recording medium are moved.

In the present specification, the term "printing" indicates the concept of forming an image including text, the image should be understood in a broad sense.

Preferably, the image forming apparatus further comprises a circuit selection control device which controls the circuit selection device in such a manner that at least one of the dummy capacitive loads to be connected to at least one of the drive waveform generating circuits is selected in accordance with electrostatic capacitance of at least one of the pressure generating elements which is driven by the at least one of the drive waveform generating circuits.

According to this aspect of the present invention, a circuit selection control device is provided which controls the circuit selection devices in such a manner that they select dummy capacitive loads to be connected to the drive waveform generating circuits, in accordance with the electrostatic capacitance of the pressure generating elements driven by a portion or all of the plurality of drive waveform generating circuits. Therefore, desirable dummy capacitive loads are selected in accordance with the load to be driven by the drive waveform generating circuits, waveform distortion is prevented in the drive signal supplied to the pressure generating elements, and redundant application of dummy capacitive loads to the drive waveform generating circuits is prevented. Specifically, dummy capacitive loads can be reduced and this reduction in the load can be assigned to the pressure generating elements. Therefore, deterioration of image quality in the formed image due to the waveform distortion in the drive signal is prevented, and increase in the power consumption of the drive waveform generating circuits is suppressed.

Preferably, the circuit selection control device controls the circuit selection device in such a manner that total of the electrostatic capacitance of the at least one of the pressure generating elements and electrostatic capacitance of the at least one of the dummy capacitive loads which are connected to the at least one of the drive waveform generating circuits, becomes a prescribed value.

According to this aspect of the present invention, the circuit selection device is controlled in such a manner that the total of the electrostatic capacitance (capacitance component) of the pressure generating elements, and the electrostatic capacitance of the dummy capacitive loads, becomes a prescribed value. Thus, the dummy capacitive loads corresponding to the drive waveform generating circuits are optimized, and a desirable drive signal can be supplied to the pressure generating elements, regardless of the drive conditions of the drive waveform generating circuits. Furthermore, the power consumption of the drive waveform generating circuits is made to be uniform. Therefore, there is no redundancy in the scale of the drive waveform generating circuits or the circuit selection device, and furthermore, the elements used in the circuits of these can be reduced in the size (the circuits can be compact).

In an example where a plurality of drive waveform generating circuits are operated substantially simultaneously, desirably, control is implemented in such a manner that the loads (the capacitive loads) on the drive waveform generating circuits are substantially uniform.

The "prescribed value" in the above aspect of the present invention is preferably set to the middle value of the drive capacity range of the drive waveform generating circuits (namely, ½ of the maximum drive capacity).

Alternatively, it is also preferable that the circuit selection control device controls the circuit selection device in such a manner that total of the electrostatic capacitance of the at least one of the pressure generating elements and electrostatic capacitance of the at least one of the dummy capacitive loads which are connected to the at least one of the drive waveform generating circuits, falls within a prescribed range.

According to this aspect of the present invention, the circuit selection device is controlled in such a manner that the total of the electrostatic capacitance (capacitance component) of the pressure generating element and the electrostatic capacitance of the dummy capacitive loads, comes within a prescribed range. Therefore, the range within which the dummy capacitive loads can be selected is increased, and more flexible circuit selection control becomes possible, compared to circuit selection control which causes the capacitive load driven by the drive waveform generating circuits to be a prescribed value.

In the circuit selection control according to the above aspect of the present invention, it is also possible to appropriately combine the following controls in accordance with the image formation conditions, the image forming apparatus, and the environmental conditions of the liquid ejection head (temperature, humidity, and the like). Specifically, the total of the electrostatic capacitance (capacitance component) of the pressure generating elements, and the electrostatic capacitance of the dummy capacitive loads, can be controlled "so as to be the upper limit value of the prescribed range", controlled "so as to be the lower limit value of the prescribed range", or controlled "so as to be the middle value of a prescribed range", in accordance with the image formation conditions, the image forming apparatus, and the environmental conditions of the liquid ejection head (temperature, humidity, and the like).

If the total of the electrostatic capacitance (capacitance component) of the pressure generating elements and the electrostatic capacitance of the dummy capacitive loads is controlled so as to be the upper limit of the prescribed range, then this gives priority to increasing the number of pressure generating elements capable of being driven by one drive waveform generating circuit, and hence is suitable for high-speed mode, for example. On the other hand, the total of the electrostatic capacitance (capacitance component) of the pressure generating elements and the electrostatic capacitance of the dummy capacitive loads is controlled so as to be the lower limit of the prescribed range, then it is possible to reduce the power consumption of the drive waveform generating circuits and the circuit selection device, and this is suitable for low-power-consumption mode, for example.

Preferably, a plurality of the circuit selection devices are provided.

The plurality of circuit selection devices according to this aspect of the present invention may have the same specifications, or they may have different specifications. For example, the plurality of circuit selection devices may include devices having different numbers of switching elements.

Preferably, the circuit selection control device controls the circuit selection devices in such a manner that total of electrostatic capacitance of the at least one of the pressure generating elements and electrostatic capacitance of the at least one of the dummy capacitive loads which are connected to each of the circuit selection devices, falls within a prescribed range.

According to this aspect of the present invention, the circuit selection devices are controlled in such a manner that the pressure generating devices and the dummy capacitive loads are not concentrated on one particular circuit selection device. Hence, extreme heat generation in the circuit selection devices is prevented (namely, the heat generation in the circuit selection devices is distributed). Therefore, damage to the circuit selection devices is prevented, and the heat radiating devices (radiators, cooling fans, and the like) provided in the circuit selection devices and their peripheral circuits, can be reduced in size.

Furthermore, by adopting a prescribed range as the control range, it becomes possible to control the circuit selection devices in a more flexible way, thus helping to reduce the control burden on the control system. Furthermore, the number of dummy capacitive loads can also be reduced, and the drive circuits (drive waveform generating circuits) of the dummy capacitive loads, and their peripheral circuits, can be reduced in size.

Alternatively, it is also preferable that the circuit selection control device controls the circuit selection devices in such a manner that total of electrostatic capacitance of the at least one of the pressure generating elements and electrostatic capacitance of the at least one of the dummy capacitive loads which are connected to each of the circuit selection devices, becomes a prescribed value.

According to this aspect of the present invention, it is possible to make the power consumption of the circuit selection devices uniform, and hence there is no redundancy in the circuit selection devices and their peripheral circuits (operating margins can be decreased), and the circuits can be reduced in size. Even more desirably, control is implemented in such a manner that the power consumption of the plurality of circuit switching devices becomes substantially uniform.

Preferably, electrostatic capacitance of at least one of the dummy capacitive loads is different from electrostatic capacitance of other of the dummy capacitive loads.

According to this aspect of the present invention, by providing dummy capacitive loads having different electrostatic capacitances, the selection of dummy capacitive loads can be controlled more readily. Moreover, the overall number of dummy capacitive loads and the number of connections can be reduced. Furthermore, the circuitry in the drive waveform generating circuits and the circuit selection devices can be reduced in scale, thus allowing high-density installation.

According to the present invention, a plurality of dummy capacitive loads are connected to the drive waveform generating circuits via the circuit selection device. Therefore, it is possible to connect the plurality of dummy capacitive loads to the drive waveform generating circuits in a selective fashion. Furthermore, a plurality of dummy capacitive loads are appropriately selected and used as circumstances demand, on the basis of the drive load of each drive waveform generating circuit (the total of the electrostatic capacitance of the pressure generating elements and the dummy capacitive loads). Hence, the capacitive load of each drive waveform generating circuit can be controlled, variations in image quality caused by distortion of the drive waveform can be suppressed, and furthermore, higher-speed printing can be achieved. Furthermore, by distributing the load, it is possible to distribute the power consumption and heat generated by the drive waveform generating circuits, and therefore the circuitry, the heat radiators, and the like, can be reduced in size. Furthermore, by appropriately controlling the phases of the plurality of drive signal waveforms, it is possible to reduce the current consumption of each of the drive waveform generating circuits.

BRIEF DESCRIPTION OF THE DRAWINGS

The nature of this invention, as well as other objects and benefit thereof, will be explained in the following with reference to the accompanying drawings, wherein.

DETAILED DESCRIPTION OF THE PREFERRED EMBODIMENTS

General Composition of Inkjet Recording Apparatus

Figure 1:
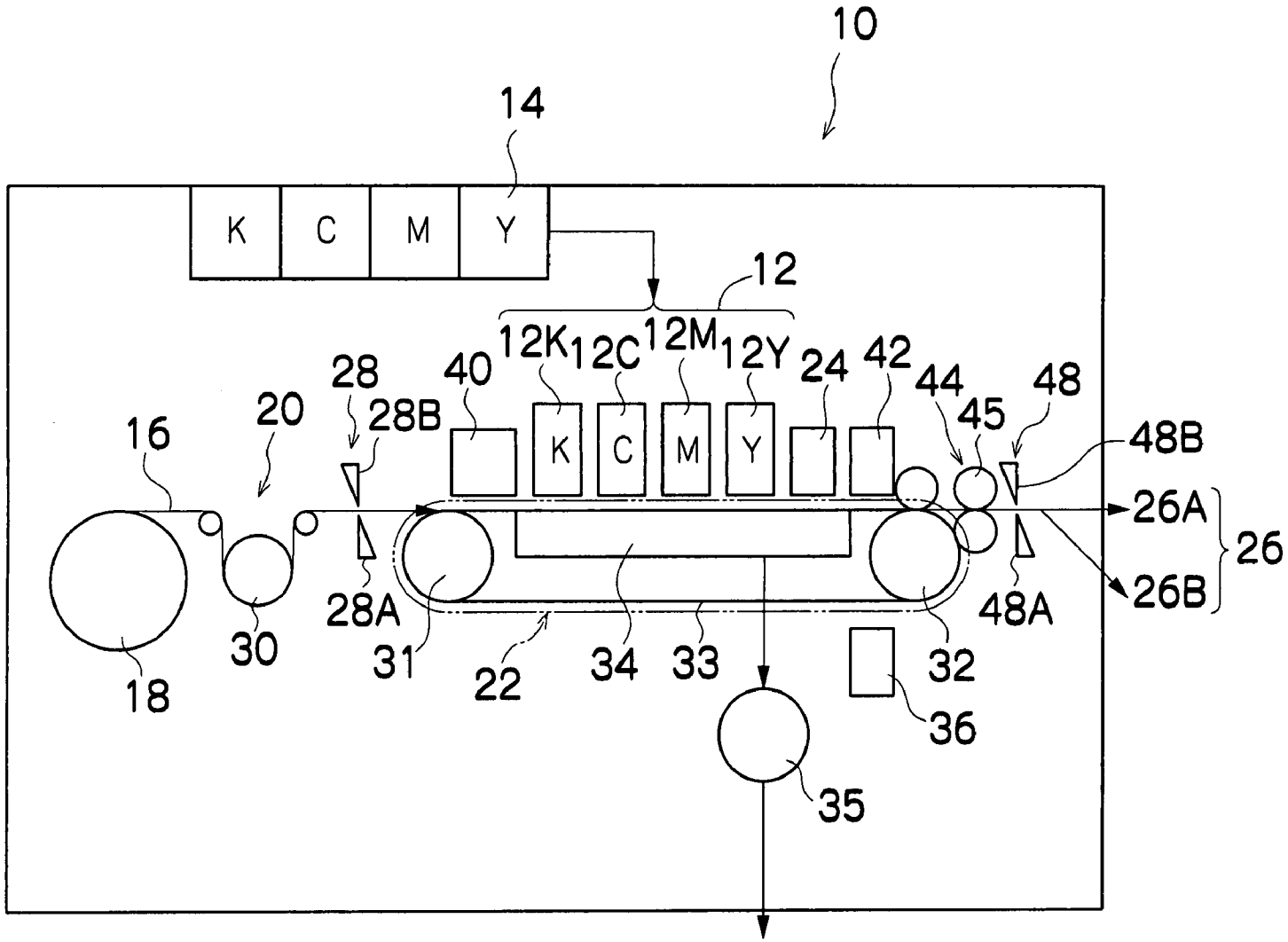
FIG. 1 is a general schematic drawing of an inkjet recording apparatus relating to an embodiment of the present invention.

FIG. 1 is a general configuration diagram of an inkjet recording apparatus according to an embodiment of the present invention. As shown in FIG. 1, the inkjet recording apparatus 10 comprises: a printing unit 12 having a plurality of inkjet heads (hereinafter, called "heads") 12K, 12C, 12M, and 12Y provided for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying a piece of recording paper 16 which is a recording medium; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The ink storing and loading unit 14 has ink tanks for storing the inks of K, C, M, and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The cut recording paper 16 that is decurled is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a possibility in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed before the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
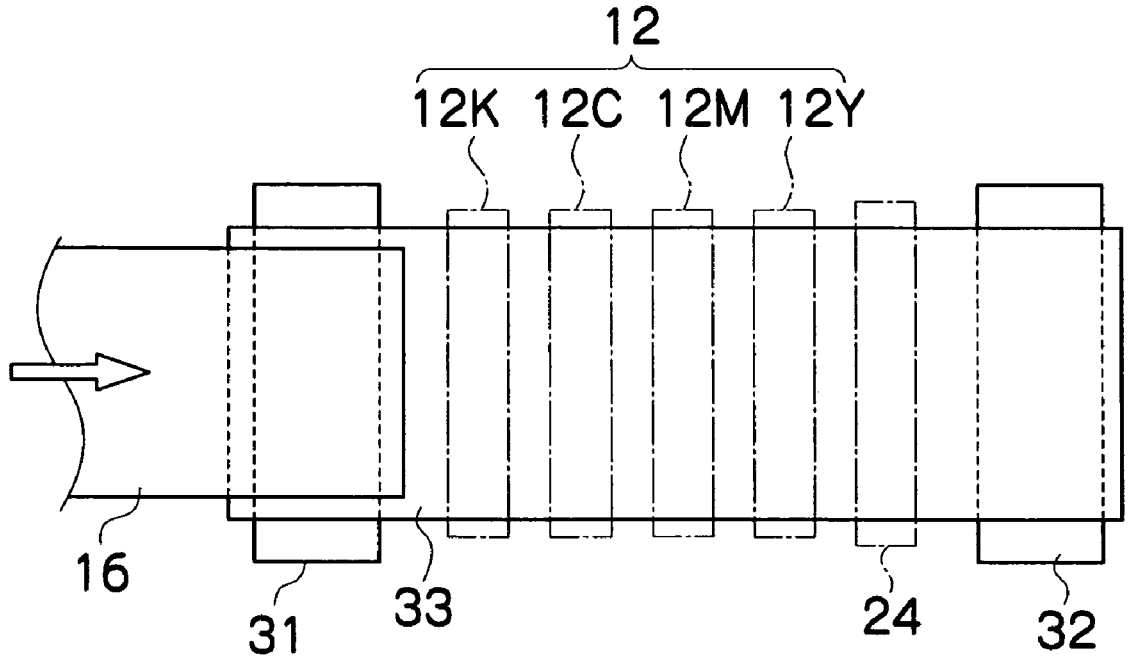
FIG. 2 is a principal plan diagram of the peripheral area of a print unit in the inkjet recording apparatus illustrated in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M, and 12Y, while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions on the sequence in which the heads of respective colors are arranged.

The print determination unit 24 shown in FIG. 1 has an image sensor for capturing an image of the ink-droplet deposition result by the printing unit 12, and functions as a device to check for ejection defects such as a blockage in the nozzles in the printing unit 12 on the basis of the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row with an R filter including photoelectric transducing elements (pixels) arranged in a line provided, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print heads 12K, 12C, 12M, and 12Y of the respective colors is read in by the print determination unit 24, and the ejection performed by each head is determined. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matters with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of the heads is described below. The heads 12K, 12C, 12M, and 12Y of the respective ink colors have the same structure, and a reference numeral 50 is hereinafter designated to any of the heads.

Figure 3A:
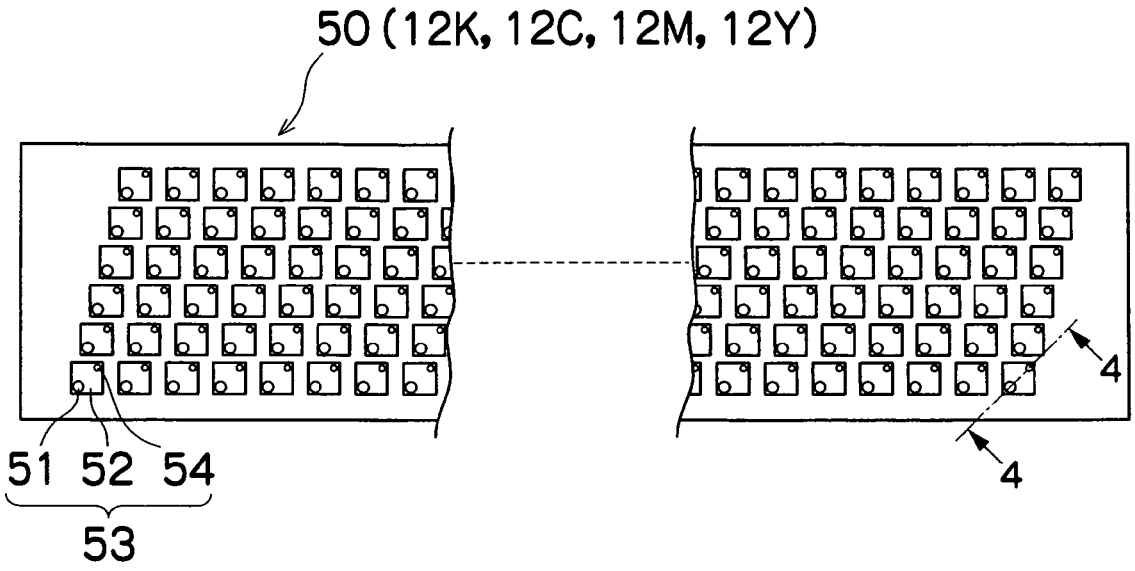
FIG. 3A is a plan view perspective diagram showing an example of the composition of a print head.
Figure 3B:
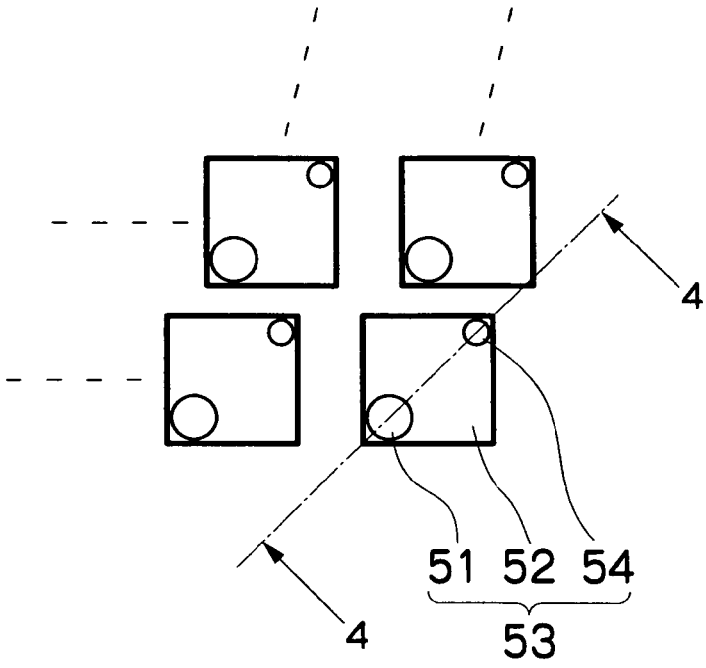
FIG. 3B is a principal enlarged view of FIG. 3A.
Figure 3C:
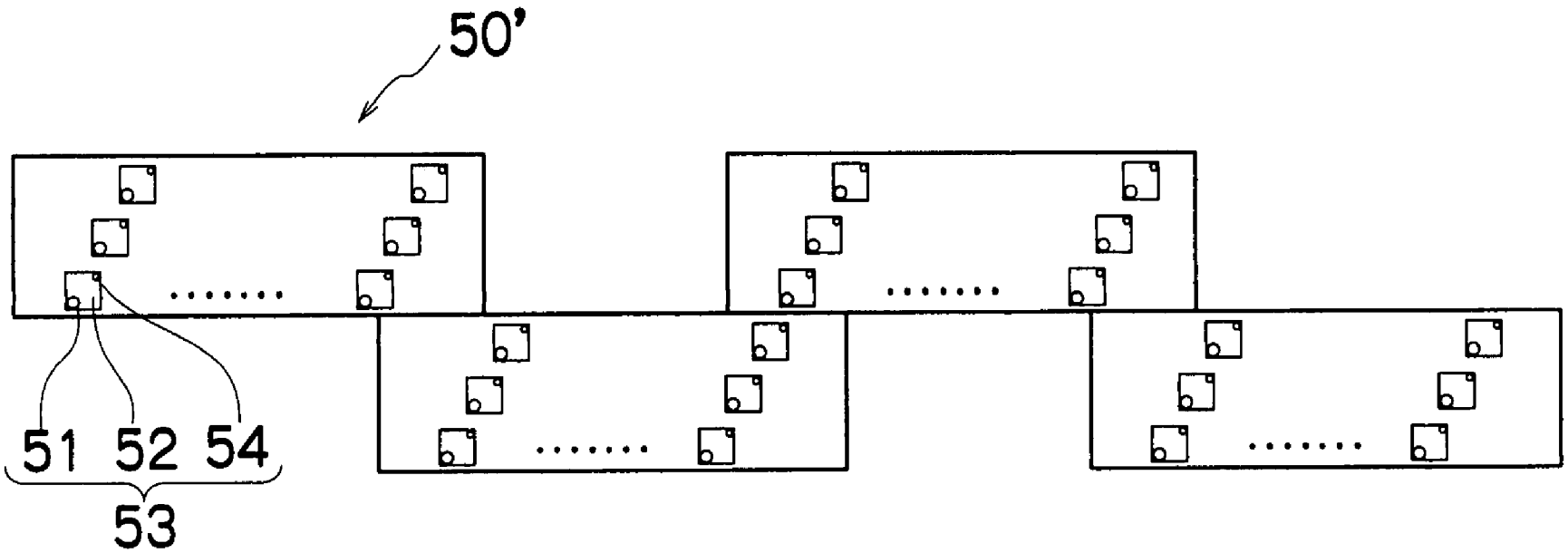
FIG. 3C is a plan view perspective diagram showing a further example of the composition of a full line head.
Figure 4:
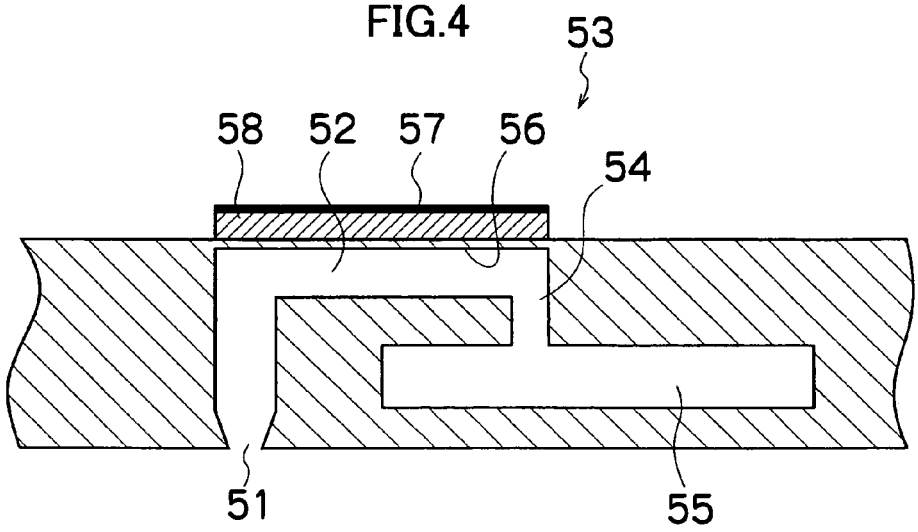
FIG. 4 is a cross-sectional view along line 4-4 in FIG. 3A.

FIG. 3A is a perspective plan view showing an example of the configuration of the head 50, FIG. 3B is an enlarged view of a portion thereof, FIG. 3C is a perspective plan view showing another example of the configuration of the head 50, and FIG. 4 is a cross-sectional view taken along the line 4-4 in FIGS. 3A and 3B, showing the inner structure of a droplet ejection element (an ink chamber unit for one nozzle 51).

The nozzle pitch in the head 50 should be minimized in order to maximize the density of the dots printed on the surface of the recording paper 16. As shown in FIGS. 3A and 3B, the head 50 according to the present embodiment has a structure in which a plurality of ink chamber units (droplet ejection elements) 53 are disposed two-dimensionally in the form of a staggered matrix, each ink chamber unit 53 comprising a nozzle 51 forming an ink droplet ejection port, a pressure chamber 52 corresponding to the nozzle 51, and the like. Hence, the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 16 in a direction substantially perpendicular to the conveyance direction of the recording paper 16 is not limited to the example described above. For example, instead of the configuration in FIG. 3A, as shown in FIG. 3C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

As shown in FIGS. 3A and 3B, the planar shape of the pressure chamber 52 provided for each nozzle 51 is substantially a square, and an outlet to the nozzle 51 and an inlet of supplied ink (supply port) 54 are disposed in both corners on a diagonal line of the square.

As shown in FIG. 4, each pressure chamber 52 is connected to a common channel 55 through the supply port 54. The common channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

An actuator 58 (pressure generating element) provided with an individual electrode 57 is bonded to a pressure plate 56 (a diaphragm that also serves as a common electrode) which forms the ceiling of the pressure chamber 52. If a drive voltage is applied to the individual electrode 57, then the actuator 58 is deformed, the volume of the pressure chamber 52 is thereby changed, and the pressure in the pressure chamber 52 is thereby changed, so that the ink inside the pressure chamber 52 is thus ejected through the nozzle 51. A piezoelectric element, typified by a piezo element, is preferably used as the actuator 58. When ink is ejected, new ink is supplied to the pressure chamber 52 from the common flow channel 55 through the supply port 54.

Figure 5:
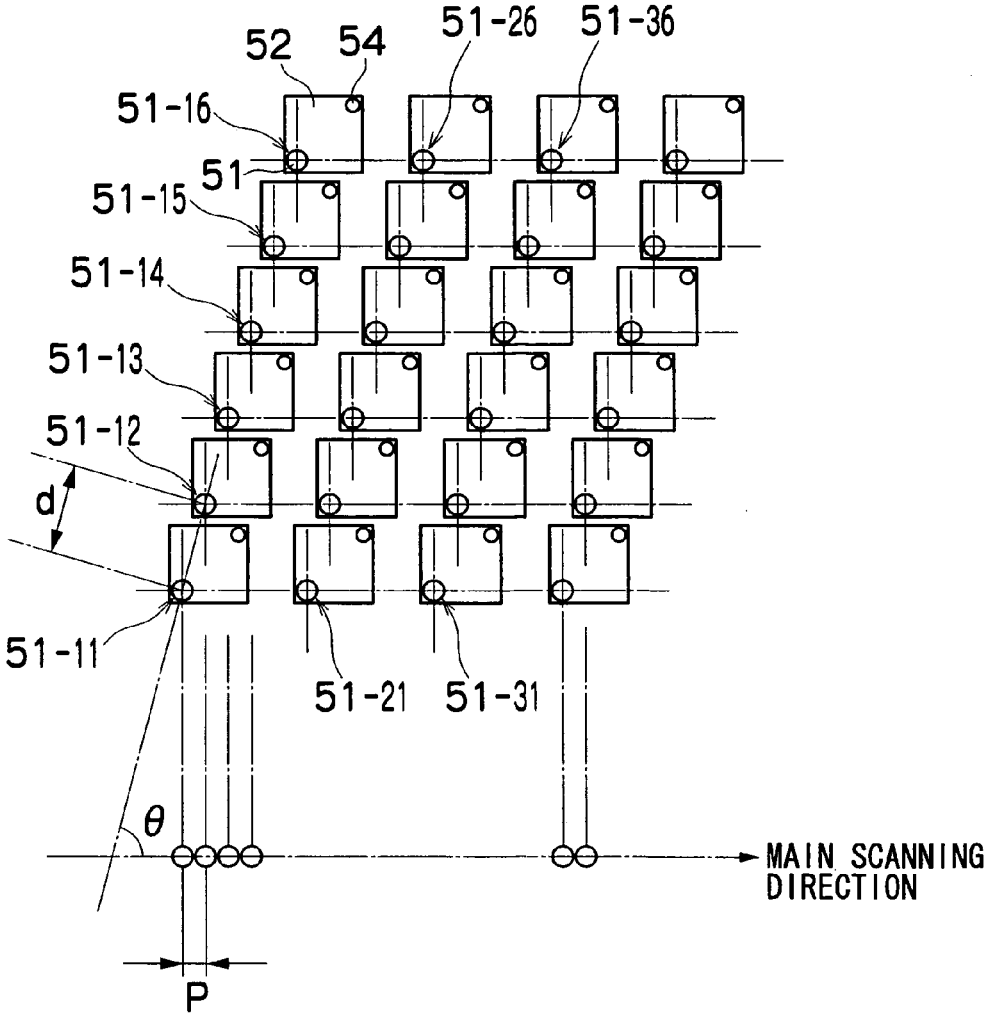
FIG. 5 is an enlarged view showing a nozzle arrangement in the print head illustrated in FIG. 3A.

As shown in FIG. 5, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is d×cos θ, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. In implementing the present invention, the arrangement of the nozzles is not limited to that of the example illustrated.

Composition of Ink Supply System

Figure 6:
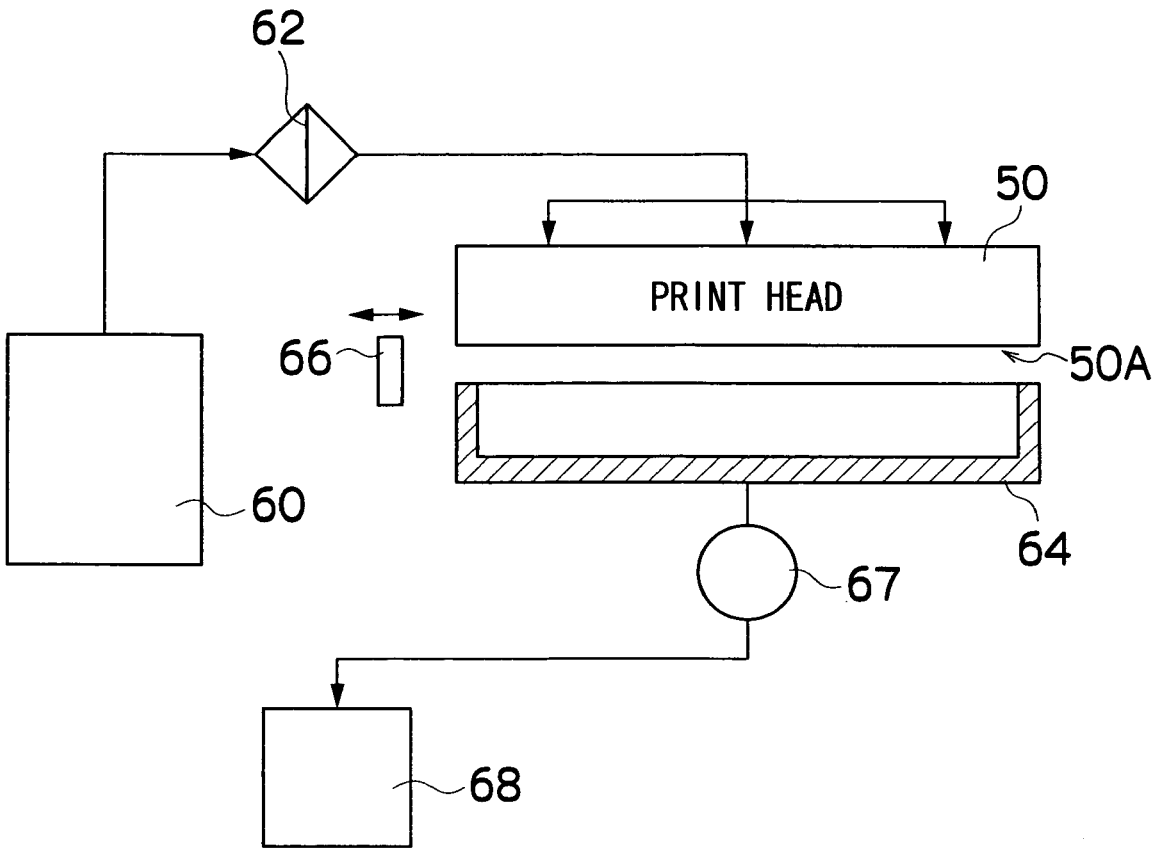
FIG. 6 is a schematic drawing showing the composition of an ink supply system in the inkjet recording apparatus.

FIG. 6 is a schematic drawing showing the configuration of the ink supply system in the inkjet recording apparatus 10. The ink tank 60 is a base tank that supplies ink to the head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the head 50 as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face 50A is thereby covered with the cap 64.

The cleaning blade 66 is composed of rubber or another elastic member, and can slide on the ink ejection surface (surface of the nozzle plate) of the head 50 by means of a blade movement mechanism (not shown). When ink droplets or foreign matter has adhered to the nozzle plate, the surface of the nozzle plate is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed in the ink inside the head 50 (inside the pressure chamber 52), the cap 64 is placed on the head 50, the ink inside the pressure chamber 52 (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the head 50, or when service has started after a long period of being stopped.

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary discharge to eject the ink whose viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, ink can no longer be ejected from the nozzle 51 even if the actuator 58 is operated. Also, when the ink viscosity inside the nozzle 51 has increased over a certain level, ink can no longer be ejected from the nozzle 51 even if the actuator 58 is operated. In these cases, a suctioning device to remove the ink inside the pressure chamber 52 by suction with a suction pump, or the like, is placed on the nozzle face 50A of the head 50, and the ink in which bubbles have become intermixed or the ink whose viscosity has increased is removed by suction.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

Description of Control System

Figure 7:
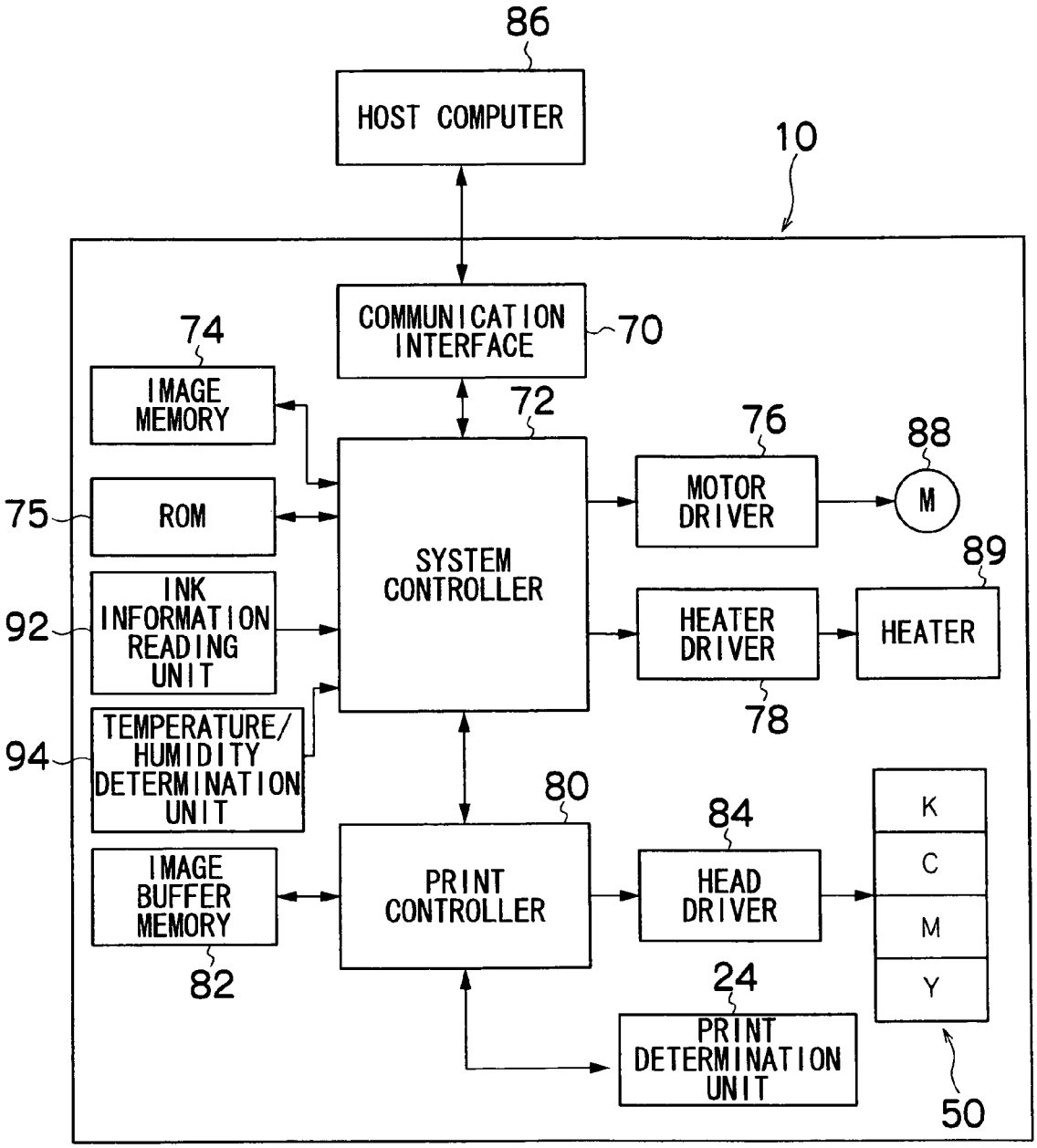
FIG. 7 is a principal block diagram showing the system composition of an inkjet recording apparatus.

FIG. 7 is a principal block diagram showing the system configuration of the inkjet recording apparatus 10. The inkjet recording apparatus 10 comprises a communication interface 70, a system controller 72, an image memory 74, a ROM 75, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data and control parameters which are required for control procedures are stored in the ROM 75. The ROM 75 may be a non-writeable storage element (storage device), or it may be a rewriteable storage element, such as an EEPROM. The image memory 74 is used as a temporary storage region for the image data, and it is also used as a program development region and a calculation work region for the CPU.

The motor driver 76 drives the motor 88 in accordance with commands from the system controller 72. The heater driver 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 of the heads of the respective colors 12K, 12C, 12M and 12Y on the basis of dot data supplied by the print controller 80. The head driver 84 can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted into dot data for each ink color by a known dithering algorithm, random dithering algorithm or another technique in the print controller 80. In other words, the print controller 80 performs processing for converting the inputted RGB image data into dot data for four colors, K, C, M, and Y. The dot data generated by the print controller 80 is stored in the image buffer memory 82.

The head driver 84 outputs signal for driving the actuators 58 of the head 50, on the basis of the dot data stored in the image buffer memory 82, and ink is ejected from the head 50 by applying the drive signals output by the head driver 84 to the head 50. By controlling ink ejection from the heads 50 in tune with the conveyance velocity of the recording paper 16, an image is formed on the recording paper 16.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the head 50 on the basis of information obtained from the print determination unit 24. Furthermore, the system controller 72 implements control for carrying out preliminary ejection, suctioning, and other prescribed restoring processes on the head 50, on the basis of the information obtained from the print determination unit 24.

In addition, the inkjet recording apparatus 10 according to this example has an ink information reading unit 92 and a temperature and humidity determination unit 94. The ink information reading unit 92 is a device for reading in information relating to the ink type. More specifically, it is possible to use, for example, a device which reads in ink properties information from the shape of the cartridge in the ink tank 60 (a specific shape which allows the ink type to be identified), or from a bar code or IC chip incorporated into the cartridge. Besides this, it is also possible that an operator inputs the required information through a user interface.

The temperature and humidity determination unit 94 is a block which includes determination devices, such as sensors for determining the environment in which the inkjet recording apparatus 10 is located, sensors for determining the temperature and humidity of the parts (e.g., the print head 50) of the inkjet recording apparatus 10, and sensors for determining the temperature of the ink.

The information obtained from the various devices, such as the ink information reading unit 92 and the temperature and humidity determination unit 94, is supplied to the system controller 72 and used to control ejection of the ink (to control the ejection volume and ejection timing) and the like.

Sensors for determining temperature and humidity of a plurality of the parts of the inkjet recording apparatus 10 are included in the temperature and humidity determination unit 92 shown in FIG. 7.

Figure 8:
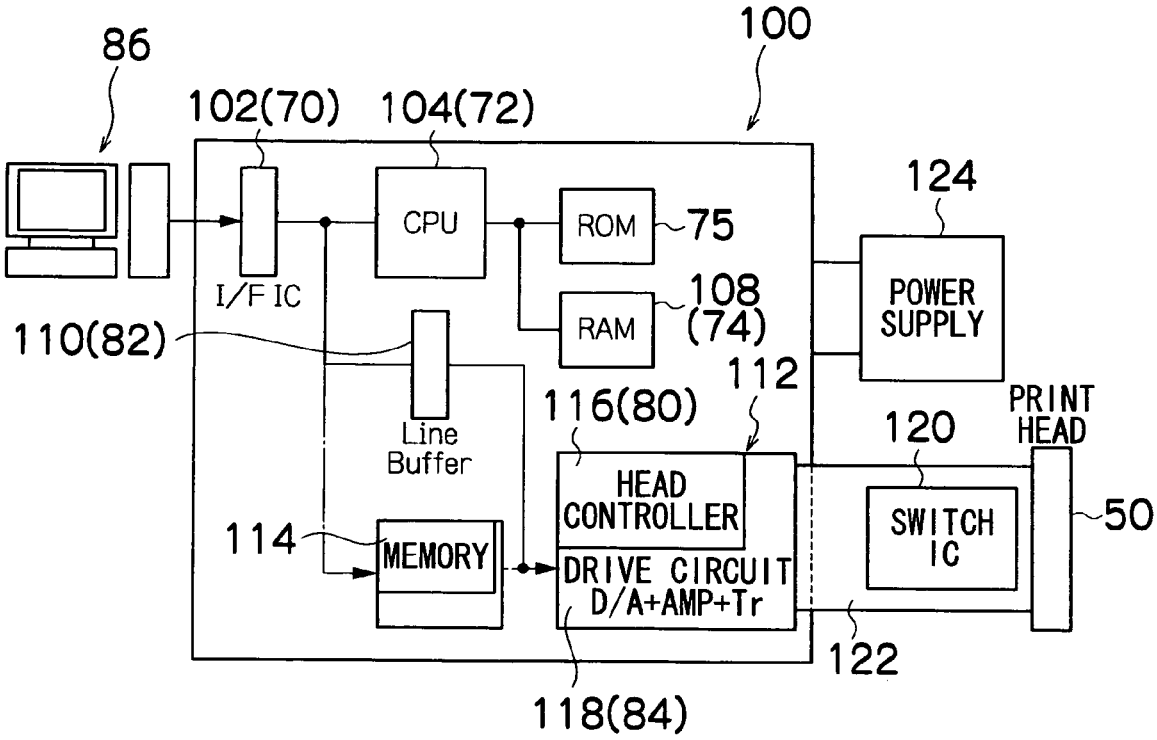
FIG. 8 is a principal schematic drawing of the main circuitry relating to head driving of an inkjet recording apparatus according to the embodiment.

Next, a drive method of the print head 50 in the inkjet recording apparatus 10 according to the present embodiment is described below. FIG. 8 is a principal compositional diagram of the main circuitry relating to the head driving in the inkjet recording apparatus 10. A communications interface IC 102, CPU 104, ROM 75, RAM 108, line buffer 110, and driver IC 112 are installed on a circuit substrate 100 mounted on the inkjet recording apparatus 10.

The communications interface IC 102 corresponds to the communications interface indicated by the reference numeral 70 in FIG. 7. The CPU 104 in FIG. 8 functions as the system controller 72 shown in FIG. 7. The RAM 108 in FIG. 8 functions as an image memory 74 as described in FIG. 7, and the line buffer 110 in FIG. 8 functions as an image buffer memory 82 shown in FIG. 7. It is also possible that a memory 114 is installed in the circuit substrate 100, instead of or in conjunction with the line buffer 110. A portion of the RAM 108 can serve as a portion or all of the memory 114.

Although the details of the driver IC 112 shown in FIG. 8 are described later (FIG. 9), the driver IC 112 includes a head controller 116 (corresponding to the print controller 80 described in FIG. 7) and drive circuit elements 118 (corresponding to the head driver 84 shown in FIG. 7), such as a D/A (Digital-to-Analog) converter, an amplifier, a transistor, and the like. The driver IC 112 shown in FIG. 8 is electrically connected to the print head 50 via a wiring member fitted with a switch IC 120 (circuit switching device) (for example, a wiring member which combines a flexible substrate and a rigid substrate) 122.

The switch IC 120 includes a serial/parallel (S/P) conversion circuit and a switch element array. The power supply circuit 124 is connected to this circuit substrate 100, in such a manner that electrical power is supplied to the circuit blocks from the power supply circuit 124.

Figure 9:
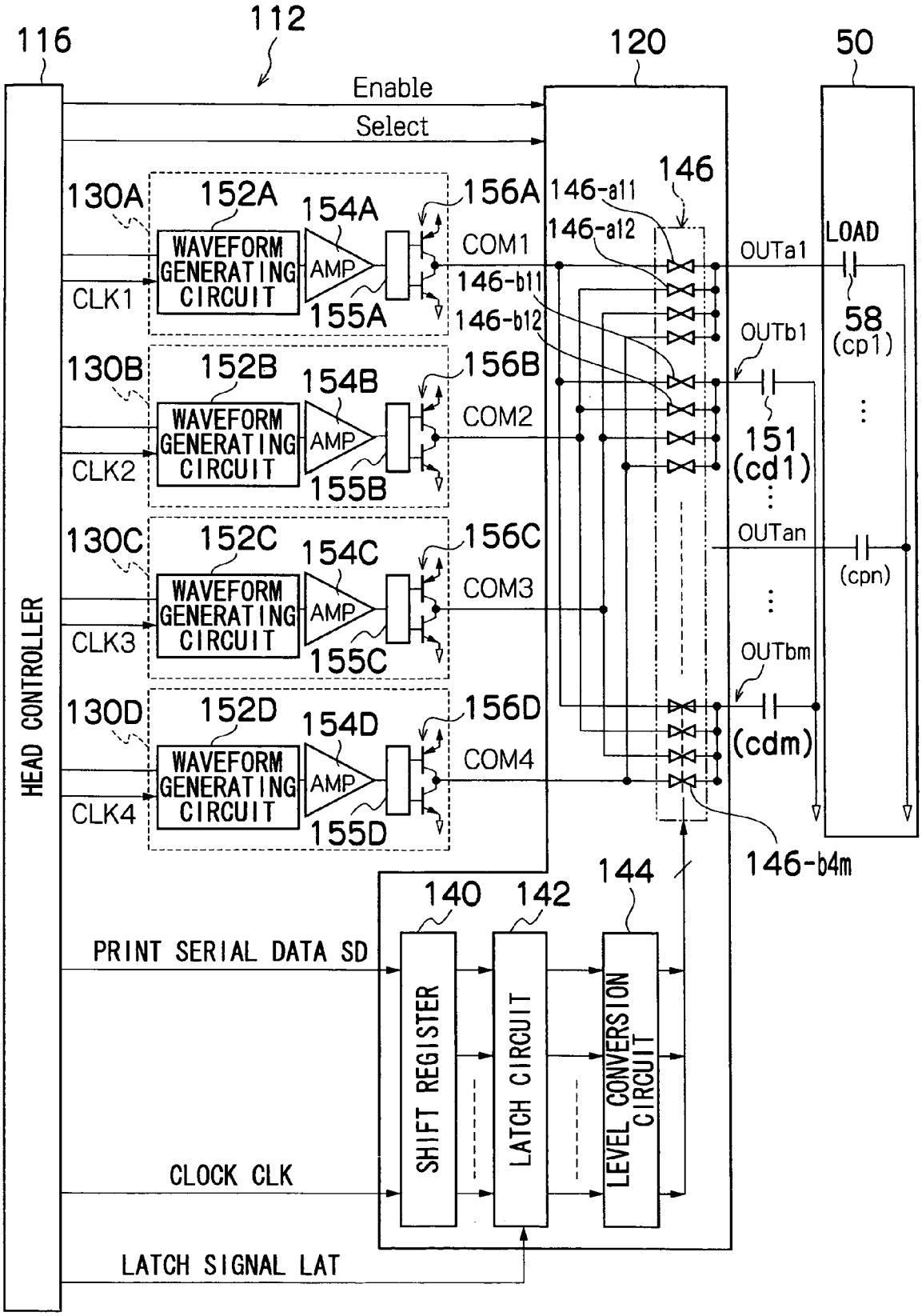
FIG. 9 is a principal schematic drawing of the main circuitry relating to head driving in a first embodiment.

FIG. 9 is a principal compositional diagram of the driver IC 112 and the switch IC 120 including the head controller 116. As shown in FIG. 9, the driver IC 112 principally includes the head controller 116, a first drive waveform generating circuit 130A, a second drive waveform generating circuit 130B, a third drive waveform generating circuit 130C, and a fourth drive waveform generating circuit 130D. The first drive waveform generating circuit 130A, the second drive waveform generating circuit 130B, the third drive waveform generating circuit 130C, and the fourth drive waveform generating circuit 130D may be referred to collectively as "drive waveform generating circuit 130" (or, for the sake of convenience, simply as "drive circuit 130").

Furthermore, as described in the diagram, the switch IC 120 includes a shift register 140, a latch circuit 142, a level conversion circuit 144, and a switch element array 146. The switch IC 120 functions as a selection circuit for selectively applying drive waveforms from the drive waveform generating circuits 130A to 130D to the n actuators 58 (Cp1 to Cpn) and the m dummy loads 151 (Cd1 to Cdm, dummy capacitance loads) of the print head 50. In FIG. 9, the elements indicated as capacitive loads together with the reference numerals OUTa1, . . . , OUTan, are the actuators (piezoelectric elements) 58 of the print head 50. Although a mode where the number of actuators 58 (n) and the number of dummy loads 151 (m) are different is described in the present example, the present example is merely one of the examples according to the present invention. The same number of the dummy loads 151 as the actuators 58 may be provided (in other words, n may be equal to m).

Each individual electrode 57 (the electrode on the left-hand side in the capacitive loads shown in FIG. 9) corresponding to each of the actuators 58 is connected to a terminal of the corresponding switching elements 146-*aij* (i=1, 2, . . . n; j=1, 2, 3, 4), and the other electrode (common electrode) of each actuator 58 is connected to ground (GND).

Furthermore, the elements indicated as capacitive loads together with the reference numerals OUTb1, . . . , OUTbm, are the dummy loads 151 provided in the print head 50. These dummy loads 151 are capacitive loads (capacitances) such as ceramic capacitors which are connected to the drive circuit 130 in parallel with the actuators 58. Each dummy load 151 has electrostatic capacitance of approximately several hundred nF, which is greater than the electrostatic capacitance of several hundred pF possessed by each element of the individual actuators 58. By using these dummy loads 151, it is possible to reduce the range of variation of the load, from the viewpoint of the drive circuit 130.

One electrode of each of the dummy loads 151 (an electrode on the right-hand side in the capacitive loads shown in FIG. 9) is connected to a terminal of the corresponding switching elements 146-*bij* (i=1, 2, . . . n; j=1, 2, 3, 4), and the other electrode of each of the dummy loads 151 is connected to the ground (GND), to which the common electrodes of the actuators 58 are connected.

The drive waveform generating circuits 130A to 130D include waveform generating circuits 152A to 152D containing D/A converters (DAC) for converting the digital waveform data output from the head controller 116 into an analog signal according to the clock signals CLK1 to CLK4; amplifier circuits 154A to 154D for amplifying the drive waveforms in accordance with the output level of the waveform generating circuits 152A to 152D; charging and discharging circuits 155A to 155D; and push-pull circuits 156A to 156D. In other words, the digital waveform data relating to an ejection drive waveform output from the head controller 116 is input to the waveform generating circuits 152A to 152D, and converted into an analog signal corresponding to the input waveform data, at the waveform generating circuits 152A to 152D. This analog waveform signal is amplified to a prescribed level by the amplifier circuit 154A to 154D, the power of the signal is amplified by the push-pull circuit 156A to 156D, and the signal is then output as a drive signal waveform. The common drive waveforms generated in this way are input to the corresponding ports "COM1" to "COM4" of the switch IC 120. In other words, the inkjet recording apparatus 10 according to the present example includes four independent drive circuits indicated by the reference numerals 130A to 130D. The number of drive circuits provided in the inkjet recording apparatus 10 (driver IC 112) is not limited to being four, and it may be three or fewer, or five or more.

The switch IC 120 is a circuit (multiplexer) which selectively switches the connection relationship between the "ports COM1 to COM4" and "the actuators 58 (OUTa1, . . . , OUTan) and the dummy loads 151 (OUTb1, . . . , OUTbm)", according to the control signals supplied from the head controller 116.

As shown in the diagram, the "COM1" port is connected to the input side terminals of the switching elements 146-*ai*1 (i=1, 2, . . . , n) and the input side terminals of the switching elements 146-*bi*1 (i=1, 2, . . . , m). Similar to the COM1 port, the "COM2" port is connected to the input side terminals of the switching elements 146-*ai*2 (i=1, 2, . . . , n) and the input side terminals of the switching elements 146-*bi*2 (i=1, 2, . . . , m), the "COM3" port is connected to the input side terminals of the switching elements 146-*ai*3 (i=1, 2, . . . , n) and the input side terminals of the switching elements 146-*bi*3 (i=1, 2, . . . , m), and the "COM4" port is connected to the input side terminals of the switching elements 146-*ai*4 (i=1, 2, . . . , n) and the input side terminals of the switching elements 146-*bi*4 (i=1, 2, . . . , m). The actuators (piezoelectric elements) 58 referred to as "OUTa1" (i=1, 2, . . . , n) are connected to the output side terminals of the switching elements 146-*ai*1 to 146-*ai*4 (i=1, 2, . . . , n), and are composed in such a manner that a drive signal can be selectively applied to the actuators (OUTa1) by controlling the on/off switching of the switching elements 146-*ai*1 to 146-*ai*4.

Furthermore, similarly, the dummy loads 151 referred to as "OUTbi" (i=1, 2, . . . , m) are connected to the output side terminals of the switching elements 146-*bi*1 to 146-*bi*4 (i=1, 2, . . . , m), and are composed in such a manner that a drive signal can be selectively applied to the actuators (OUTbi) by controlling the on/off switching of the switching elements 146-*bi*1 to 146-*bi*4.

In other words, from the viewpoint of one actuator 58, it is possible to select a drive circuit from the four drive waveform generating circuits 130A to 130D according to circumstances, and furthermore, the drive circuits 130A to 130D are composed in such a manner that they can be selectively connected to the dummy loads 151 (Cd1 to Cdm) connected to "OUTbi", by using the switching elements 146-*bij*. Although a detailed control example is described below, the nozzles that are to be driven and the volume of ink to be ejected are identified during analysis of the image data to be printed and the processing of data in order to eject ink. Therefore, in order to achieve stable ink ejection, the dummy loads 151 are selected in such a manner that the load capacity corresponding to each of the drive waveform generating circuits 130A to 130D falls within a prescribed range (or becomes a prescribed value).

According to the method of appropriately selecting the load capacitance to be connected to the plurality of drive waveform generating circuits 130A to 130D on the basis of the image data, the range of load variation can be reduced, and the fluctuation of waveforms between drive circuits can be suppressed because waveform distortion caused by load variation can be reduced. Accordingly, deterioration in image quality due to load variation can be suppressed.

As described above, the head controller 116 shown in FIG. 9 supplies digital waveform data and clock signals (CLK1 to CLK4) to the drive waveform generating circuits 130A to 130D, and supplies control signals ("Enable", "Select", and the like) for the switch IC 120. Furthermore, the head controller 116 generates print data developed into a dot pattern on the basis of the image information supplied from the host computer 86 (see FIG. 8), and also generates a latch signal (LAT) for controlling the serial transmission clock signal (CLK) and the latch timing. In tune with the clock signal CLK, the print data generated by the head controller 116 in FIG. 9, and the clock signal CLK, are sent (by serial transmission) to the shift register 140 as print serial data SD. The print data stored in the shift register 140 is latched by the latch circuit 142 on the basis of the latch signal LAT output from the head controller 116.

The signal latched by the latch circuit 142 is converted to a prescribed voltage value in the level conversion circuit 144, the prescribed voltage value being determined so that the switching elements 146-*aij* (i=1, 2, . . . , n; j=1, 2, 3, 4) and the switching elements 146-*bij* (i=1, 2, . . . , n; j=1, 2, 3, 4) can be driven. The on/off switchings of the switching elements 146-*aij* (i=1, 2, . . . , n; j=1, 2, 3, 4) and the switching elements 146-*bij* (i=1, 2, . . . , n; j=1, 2, 3, 4) are controlled according to the output signals from the level conversion circuit 144.

Figure 10A:
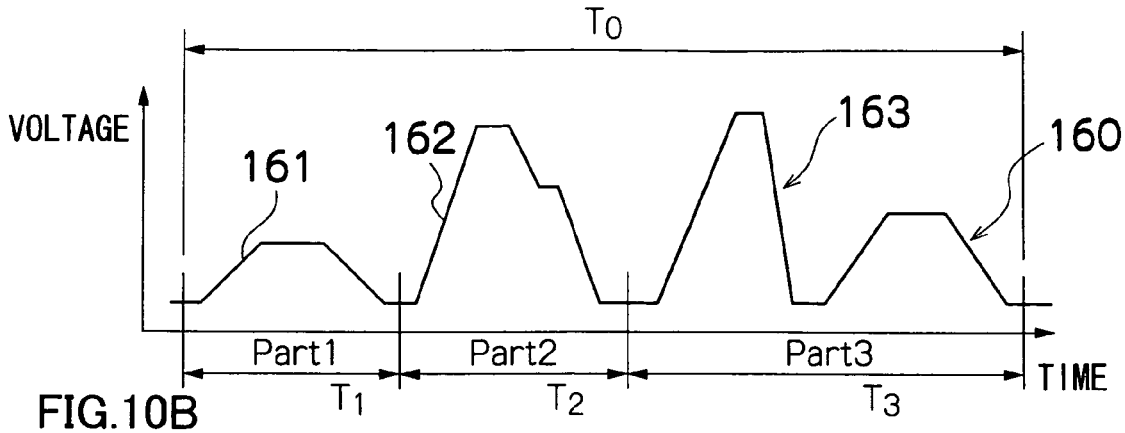
FIGS. 10A to 10E are waveform diagrams showing one example of a common drive waveform.

FIG. 10A is a waveform diagram showing one example of a common drive waveform output from the drive waveform generating circuits 130A to 130D. As shown in FIG. 10A, the common drive waveform 160 includes the following waveform components linked together in succession, the waveform components including a slight vibration waveform component 161 (the "part1" pulse section in FIG. 10A) which causes the meniscus to vibrate while the energy is restricted to a level at which ink is not ejected; a first ejection waveform component 162 (the "part 2" pulse section in FIG. 10A) for ejecting a liquid droplet for a small dot (e.g., 3 pl); and a second ejection waveform component 163 (the "part 3" pulse section in FIG. 10A) for ejecting a liquid droplet for a medium dot (e.g., 6 pl). A waveform combining these three waveform components 161 to 163 is repeated at a prescribed cycle T0.

By controlling the on and off switching of the switching elements 146-*aij* (i=1, 2, . . . , n) shown in FIG. 9, it is possible to selectively apply to the actuators 58 of the nozzles 51 the slight vibration waveform component 161, the first ejection waveform component 162, or the second ejection waveform component 163, from the common drive waveform 160 shown in FIG. 10A. Similarly, by controlling the on and off switching of the switching elements 146-*bij* (i=1, 2, . . . , n), it is possible to selectively apply to the dummy loads 151 the slight vibration waveform component 161, the first ejection waveform component 162, or the second ejection waveform component 163, from the common drive waveform 160 shown in FIG. 10A.

Figure 10B:
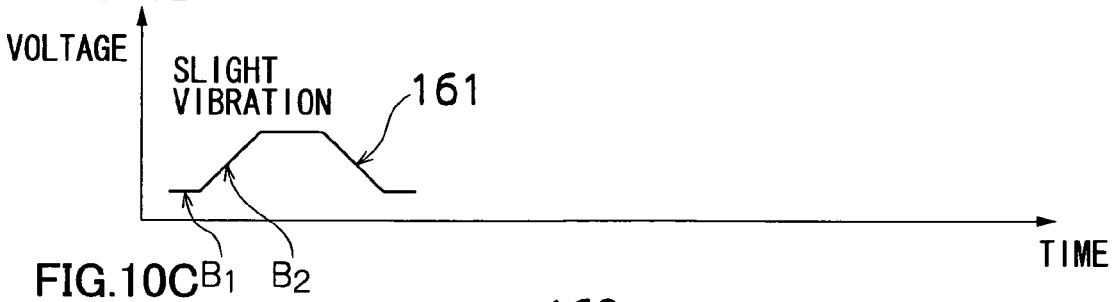

The slight vibration waveform component 161 shown in FIG. 10B has a waveform of small amplitude (voltage), compared to the other ejection waveform components (162, 163). If this slight vibration waveform component 161 is applied to one of the actuators 58, then the meniscus performs a slight vibration (vibration where ink is not ejected), and hence the increase in the viscosity of the ink is suppressed.

Figure 10C:
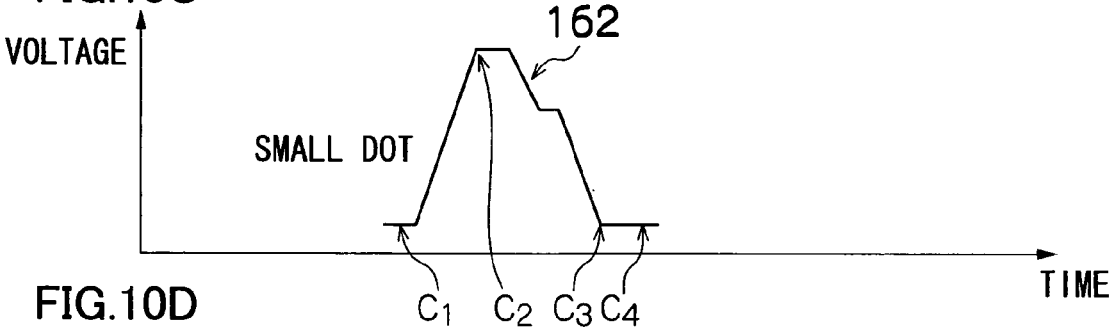
Figure 10D:
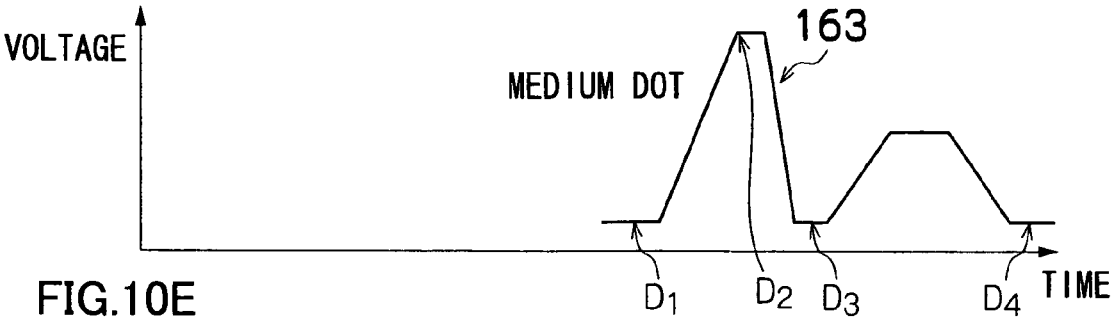

If the first ejection waveform component 162 shown in FIG. 10C is applied to one of the actuators 58, then a liquid droplet corresponding to a small dot is ejected. If only the second ejection waveform component 163 shown in FIG. 10D is applied to one of the actuators 58, then a liquid droplet corresponding to a medium dot is ejected. Furthermore, as shown in FIG. 10E, if the first ejection waveform component 162 and the second ejection waveform component 163 are consecutively applied to one of the actuators 58, then a liquid droplet corresponding to a large dot (e.g., a liquid droplet of 9 pl) is ejected.

Figure 10E:
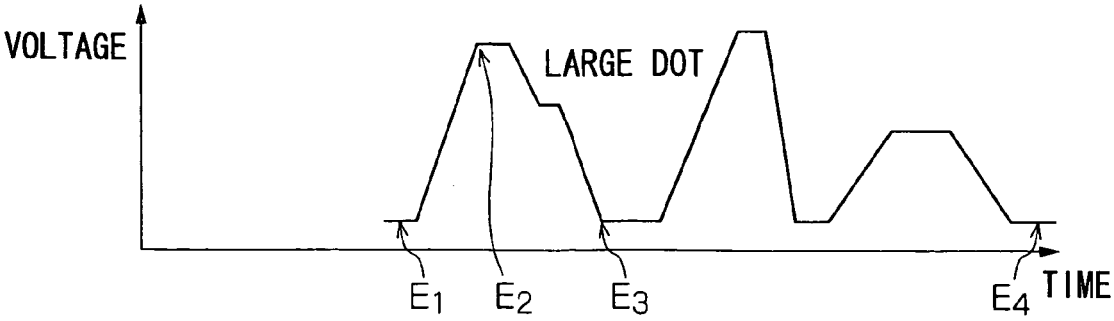

As shown in FIGS. 10C to 10E, the application timings (ejection timings) of the drive waveforms vary within the drive waveform cycle T0, in accordance with the volume of the liquid droplet to be ejected. The difference in landing positions between a small dot and a medium dot due to this time difference falls within a certain range where each of the ink droplets corresponding to the small dot and the medium dot can land within substantial one pixel of an image on the recording medium.

In the example shown in FIG. 10A, the waveform interval T1 of the slight vibration waveform component 161, the waveform interval T2 of the first ejection waveform component 162, and the waveform interval T3 of the second ejection component 163 have the relationship: T1=T2=T3/2; however, in implementing the present embodiment, the relationship between the waveform intervals of the waveform components is not limited to this example. From the viewpoint of the control, it is desirable to set the waveform interval T1 of the slight vibration waveform component 161 to 1/N (where N is a positive integer) of the drive waveform cycle T0, because this facilitates the control of the application timing of the slight vibration waveform.

In the waveform diagrams shown in FIGS. 10B to 10E, if the characters "B" to "E" are represented by "n" (where n=B, C, D, E) in the sections B1 to B2, C1 to C4, D1 to D4 and E1 to E4, then "n1" corresponds to a static meniscus, "n2" corresponds to pulling the meniscus, "n3" corresponds to pushing the meniscus (i.e., ejection), and "n4" corresponds to a state of preparation for the next ejection.

The nozzles which are to perform ejection and the nozzles which are not to perform ejection are determined on the basis of the print data, and one of the ejection waveform components shown in FIG. 10B to 10E is applied to the nozzles which are to perform printing. Furthermore, the slight vibration waveform component shown in FIG. 10A is applied at a suitable timing to all or a portion of the nozzles which are not to perform printing.

On the other hand, at least one of the aforementioned slight vibration waveform component 161 and the first to third ejection waveform components 162 to 163 is applied to the dummy loads 151. The drive waveform applied to the dummy loads 151 may be constantly one prescribed component of the aforementioned waveform components, and it may be possible to appropriately select one of the aforementioned waveform components as the drive waveform applied to the dummy loads 151.

Description of Control of Dummy Load Selection

First Embodiment

Next, the control of the selection of the dummy loads relating to the present embodiment is described below with reference to FIG. 11 and FIG. 12.

Figure 11:
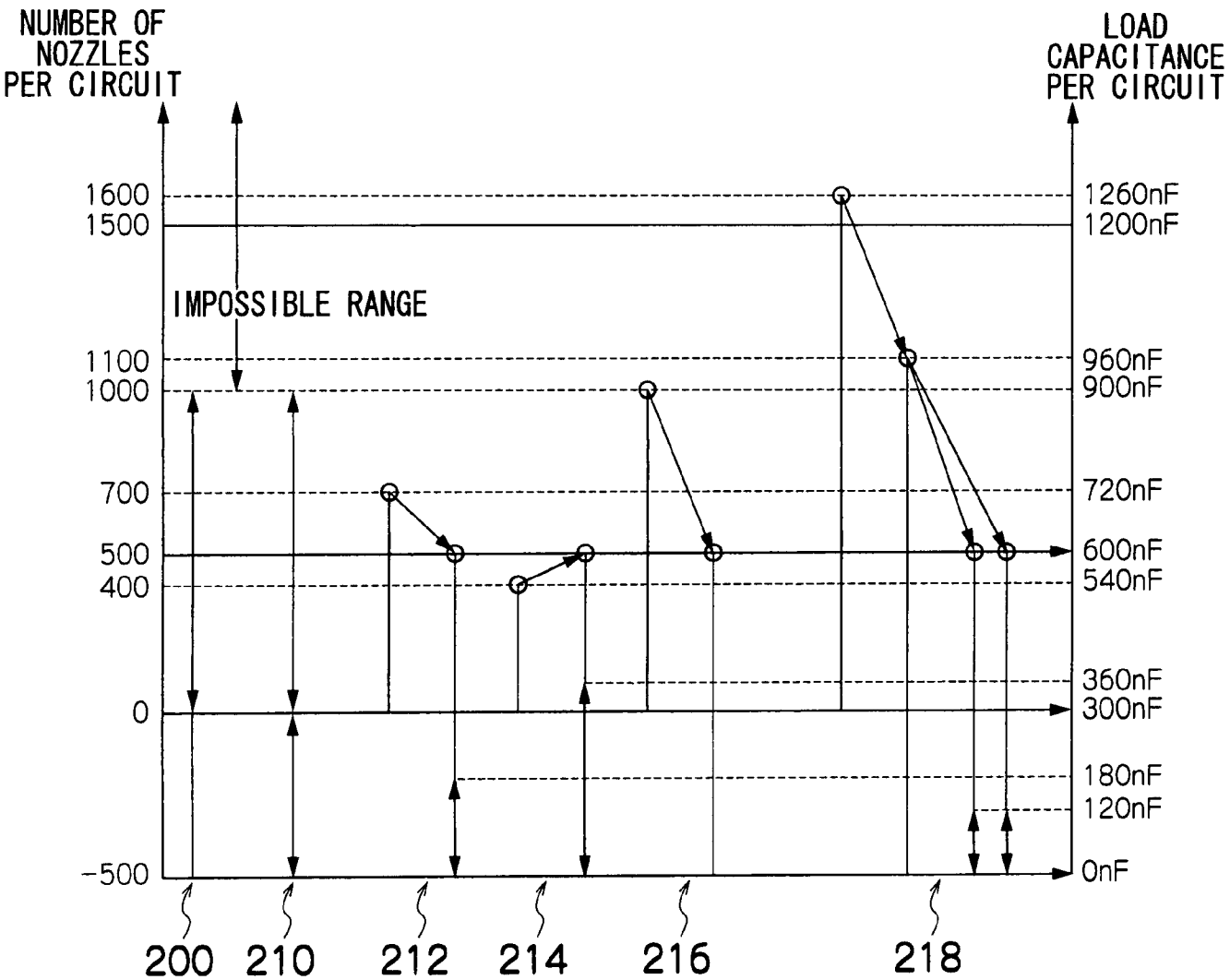
FIG. 11 is a diagram showing dummy load selection control relating to the first embodiment.

FIG. 11 is a diagram for describing the control of dummy load selection relating to the first embodiment (a diagram showing the relationship between the capacitive load and the number of nozzles (number of actuators) driven by one drive waveform generating circuit 130).

In general, if the load on a drive waveform generating circuit 130 is light, then overshooting is liable to occur (in the turning points) in the waveform of the drive signal, whereas if the load on the drive waveform generating circuit 130 is heavy, then the waveform of the drive signal is liable to get flattened. In order to avoid phenomena of these kinds, a capacitance which is greater than the capacitive load of the actuators 58 (approximately several hundred pF, in general), is connected to the power supply line along which the drive signal is transmitted.

In the present example, the dummy loads of 0 nF to 300 nF is connected to the power supply line so that the drive waveform generating circuit 130 drives a capacitive load of 0 nF to 300 nF even if there are no nozzles to be driven.

In FIG. 11, the vertical axis on the left-hand side indicates the number of nozzles driven by one drive circuit 130, and the vertical axis on the right-hand side indicates the load capacitance corresponding to the number of nozzles on the left-hand vertical axis. Furthermore, in the example shown in FIG. 11, the number of nozzles that can be driven by one drive waveform generating circuit 130 is in the range of 0 to 1000 nozzles, and the load capacitance corresponding to this number of nozzles is 300 nF to 900 nF. The range where the number of nozzles exceeds 1000 nozzles in FIG. 11 (the range where the load capacitance exceeds 900 nF) indicates an impossible range where the nozzles cannot be driven by one drive waveform generating circuit 130.

In the common print heads, as indicated by reference numeral 200, a dummy load 151 of 300 nF is provided for each drive circuit 130, in such a manner that 0 to 1000 nozzles (having total capacitance, which is the sum of the load capacitance of the actuators 58 and the dummy load 151, of 300 nF to 900 nF) are driven by one drive circuit.

On the other hand, in the print head 50 relating to the present embodiment, as indicated by reference numeral 210, the electrostatic capacitances of the dummy loads are settable, within a range of 0 nF to a reference load capacitance of 600 nF. The dummy loads 151 are selected and set in such a manner that the total capacitance driven by one drive waveform generating circuit 130 becomes the reference value of 600 nF.

For example, in the control example indicated by reference numeral 212, the number of nozzles driven by one drive waveform generating circuit 130 is 700 nozzles. In this case, the total capacitance is 720 nF if the dummy loads 151 are set to the default value of 300 nF. Therefore, the electrostatic capacitances of the dummy loads 151 are selected and set so as to be 180 nF (=300 nF−(720 nF−600 nF)), so that the total capacitance attains the aforementioned reference value of 600 nF.

Furthermore, in the control example indicated by reference numeral 214, the number of nozzles driven by one drive waveform generating circuit 130 is 400 nozzles. In this case, the total capacitance is 540 nF if the dummy load 151 is set to the default value of 300 nF. Therefore, the electrostatic capacitances of the dummy load 151 are selected and set so as to be 360 nF (=300 nF−(540 nF−600 nF)), so that the total capacitance attains the aforementioned reference value of 600 nF.

Furthermore, in the control example indicated by reference numeral 216, if the number of nozzles driven by one drive waveform generating circuit 130 is 1000 nozzles (the maximum number of nozzles which can be driven by one drive waveform generating circuit 130), then the electrostatic capacitances of the dummy loads 151 are selected and set so as to be set to 0 nF. Furthermore, although omitted from the drawing, if the number of nozzles to be driven is zero, then the electrostatic capacitances of the dummy loads 151 are set to 600 nF.

In other words, the value of the dummy loads 151 is determined as "(default value of the dummy loads 151)−{(capacitance value when dummy loads 151 are set to default value)−(reference value)}".

Furthermore, as indicated by the reference numeral 218, when the number of nozzles to be driven lies in the impossible range shown in FIG. 11 (regardless of setting the dummy loads 151 to 0 nF), then control is implemented in such a manner that the number of driven nozzles is divided into groups, and the nozzles of the divided groups are driven by the plurality of drive waveform generating circuits 130, respectively.

In the example indicated by reference numeral 218, the number of nozzles to be driven is 1600 nozzles, and the total capacitance is 1260 nF when the dummy loads 151 are set to the default value of 300 nF. Even if the dummy loads 151 are set to 0 nF, then the electrostatic capacitance is 960 nF. In this case, the switch IC 120 is controlled in such a manner that the number of nozzles to be driven is divided into two groups and the divided two groups of nozzles are driven by two drive waveform generating circuits 130.

In other words, in the example indicated by reference numeral 218, the dummy loads 151 connected to the drive waveform generating circuits 130 are set to a value of 120 nF (=300 nF−{(1260 nF−300 nF)/2−300 nF}).

The value of the aforementioned reference load capacitance is selected and set within the range of electrostatic capacitance in which it is possible to obtain a drive signal (drive waveform) that allows stable ejection of ink without causing problems with image quality (e.g., within the range of 300 nF to 900 nF in the example in FIG. 11). Desirably, the reference capacitive load is set to the middle of the range of suitable electrostatic capacitance (e.g., 600 nF in the example in FIG. 11).

Figure 12:
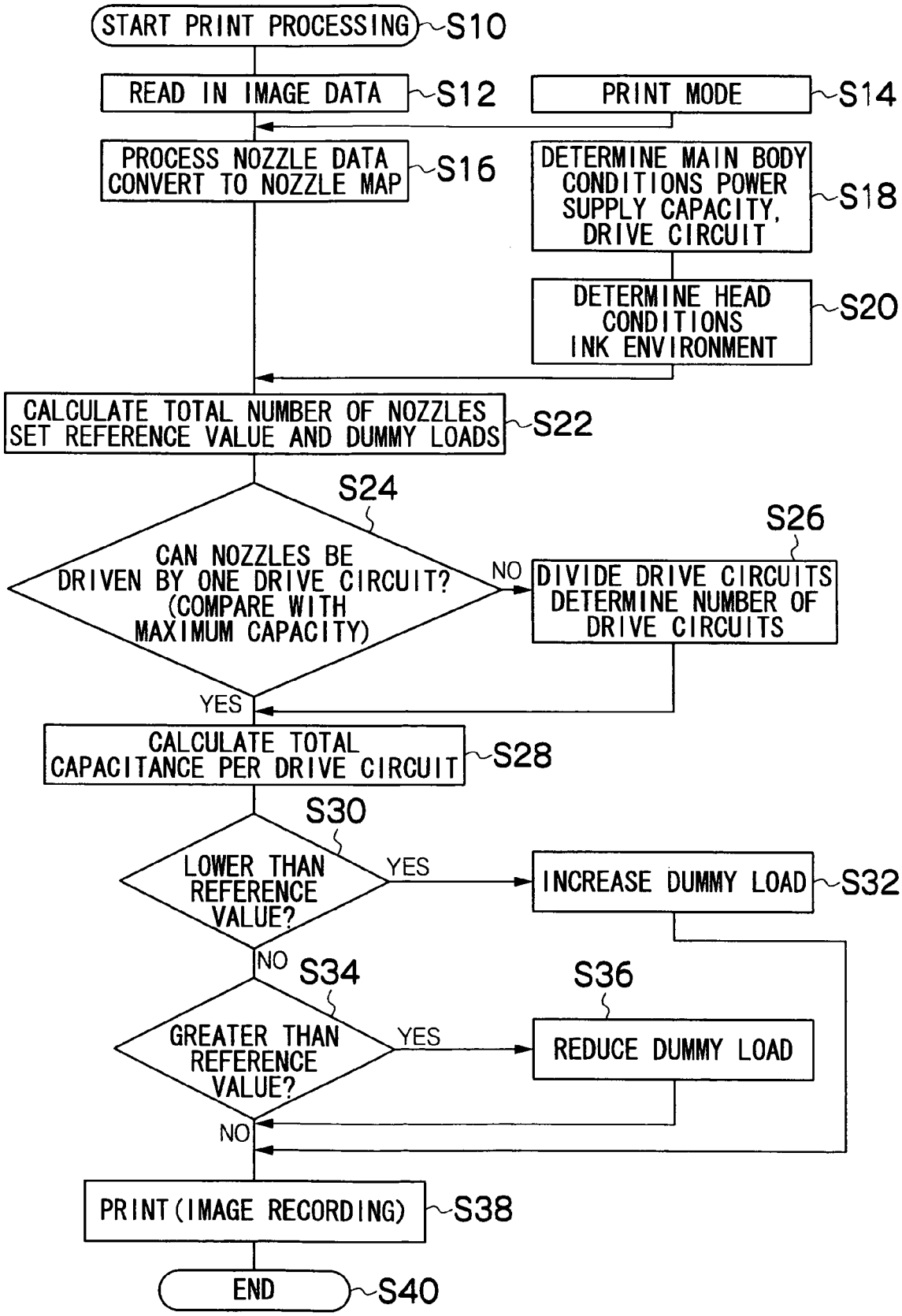
FIG. 12 is a flowchart showing a sequence of dummy load selection control relating to the first embodiment.

FIG. 12 is a flowchart showing the sequence of dummy load selection control shown in FIG. 11.

As shown in FIG. 12, after the print processing is started (S10), the image data sent from the host computer 86 shown in FIG. 7 is read in (S12 in FIG. 12). Here, when the printing conditions such as the print mode, are specified by the user (S14), nozzle data processing is carried out on the basis of these specified printing conditions, and the RGB image data is converted into a nozzle map (S16). If the printing conditions are not specified by the user at step S14, then default values are used for the printing conditions in step S16.

Thereupon, the main body conditions, such as the power supply capacity and the drive circuit, are determined (S18), and the conditions of the print head 50 (head conditions), such as the ink, temperature, humidity, and other ambient conditions, are determined (S20). The main body conditions may be composed in such a manner that the main body conditions are stored in a prescribed memory previously (for instance, when the power supply is turned on, when a print execution command is issued, or the like), and the main body conditions may be read in from the memory as needed. Furthermore, a composition is adopted in which the temperature information and the humidity information can be obtained from the temperature and humidity temperature unit 94 shown in FIG. 7.

On the basis of the nozzle map generated at step S16 in FIG. 12, the total number of nozzles to be driven is determined on the basis of the nozzle map generated at step S16 in FIG. 12. Then the reference load capacitance (reference values), and the default values of the dummy loads 151, are set (S22 in FIG. 12). The default values of the dummy loads 151 may be a fixed value, or may be changed (selected) in accordance with the printing conditions and/or image contents. At step S22, the main body conditions determined at step S18, and the head conditions determined at step S20, are referenced.

Thereupon, the procedure advances to step S24, and it is determined whether the nozzles of the total number determined at step S22 can be driven by one drive waveform generating circuit 130 (indicated as the drive circuit in FIG. 12) or not (in other words, this total number of nozzles is compared with the maximum capacity). If it is determined that the nozzles of the number cannot be driven by one drive circuit 130 (NO at S24), then the number of nozzles is divided up into the number of nozzles which can be driven by one drive circuit 130, and the number of drive waveform generating circuits 130 for driving the total number of nozzles is determined (S26). Whereupon, the procedure advances to step S28.

On the other hand, if it is determined that the number of nozzles in question can be driven by one drive waveform generating circuit 130 at step S24 (YES at S24), then the procedure advances to step S28. Then, assuming that the dummy loads 151 are set to a default value of 300 nF, the total capacitance driven by one drive waveform generating circuit 130 (or by each circuit if a plurality of drive waveform generating circuits 130 are to be used) is found. Next, it is determined whether the total capacitance is smaller than the reference value or not (S30). If it is determined at step S30 that the total capacitance determined at step S28 is smaller than the reference value (YES at S30), then the switch IC 120 is controlled in such a manner that the load of the dummy loads 151 is larger than the default value (300 nF) of the dummy loads 151 set at step S22 (S32).

After the dummy loads 151 have been selected in this way, printing (image recording) is carried out (S38). When the printing has completed, the print control sequence is terminated.

On the other hand, at step S30, if it is determined that the total capacitance determined at step S28 is greater than the reference value (NO at S30), then the procedure advances to step S34. At step S34, it is determined whether the total capacitance determined at step S28 is greater than the reference value or not. If it is determined that the total capacitance determined at step S28 is greater then the reference value (YES at S34), then the switch IC 120 is controlled in such a manner that the load of the dummy loads 151 is smaller than the default value (300 nF) of the dummy loads 151, so that the total capacitance becomes equal to the reference value (S36). The procedure then advances to step S38, and printing is carried out.

On the other hand, if it is determined that the total capacitance determined at step S28 is equal to the reference value (NO at S34), then the procedure advances to step S38 and printing is carried out.

In the print head 50 of the inkjet recording apparatus 10 having the composition described above, the electrostatic capacitances of the dummy loads 151 connected to the drive waveform generating circuits 130 are composed so as to be selectable in accordance with the number of nozzles to be driven (the total capacitance given by the sum of the capacitive load of the actuators 58 involved in ejection and the capacitive load of the dummy loads 151 not involved in ejection), in such a manner that the load capacitance driven by the drive waveform generating circuits 130 is the reference load capacitance value. Therefore, even if there is variation in the number of nozzles to be driven, waveform distortion does not arise in the drive signals, and high-quality image recording can be achieved by performing stable and desirable ink ejection. In other words, the drive waveform generating circuits 130 are controlled in such a manner that the quality of the recorded image is prioritized.

Furthermore, since the selection of the dummy loads 151 is controlled in such a manner that the total capacitance is equal to the prescribed reference value, then the dummy loads 151 are not driven redundantly. Hence, the power consumption of the switch IC 120, the drive waveform generating circuits 130, and the peripheral circuits thereof, is reduced and the size of the related circuitry can be reduced, in comparison with a case where fixed dummy loads are provided.

Moreover, a composition is adopted in which a drive waveform generating circuit can be selected among the plurality of drive waveform generating circuits 130, from the viewpoint of one of the actuators 58 and the dummy loads 151. Thus, if the capacitive load to be driven by one drive waveform generating circuit 130 (the total capacitance) is greater than the maximum drive capacity of that drive waveform generating circuit 130, then the capacitive load can be driven by the plurality of drive waveform generating circuits 130. In other words, by distributing the capacitive load among the plurality of drive waveform generating circuits 130, it is possible to reduce the capacitive load driven by one drive waveform generating circuit 130.

The dummy loads 151 may have the same electrostatic capacitance as the electrostatic capacitance (capacitive load) of the actuators 58, or they may have a different electrostatic capacitance from the actuators 58. By providing a plurality of types of dummy loads 151 (having different electrostatic capacitances), the selectable (settable) range of the electrostatic capacitance of the dummy loads 151 is large and the selection control becomes easier. Moreover, the number of dummy loads 151 and the number of connections can be reduced, the circuitry can be composed more compactly, and the dummy loads 151 can be installed at high density.

Figure 13:
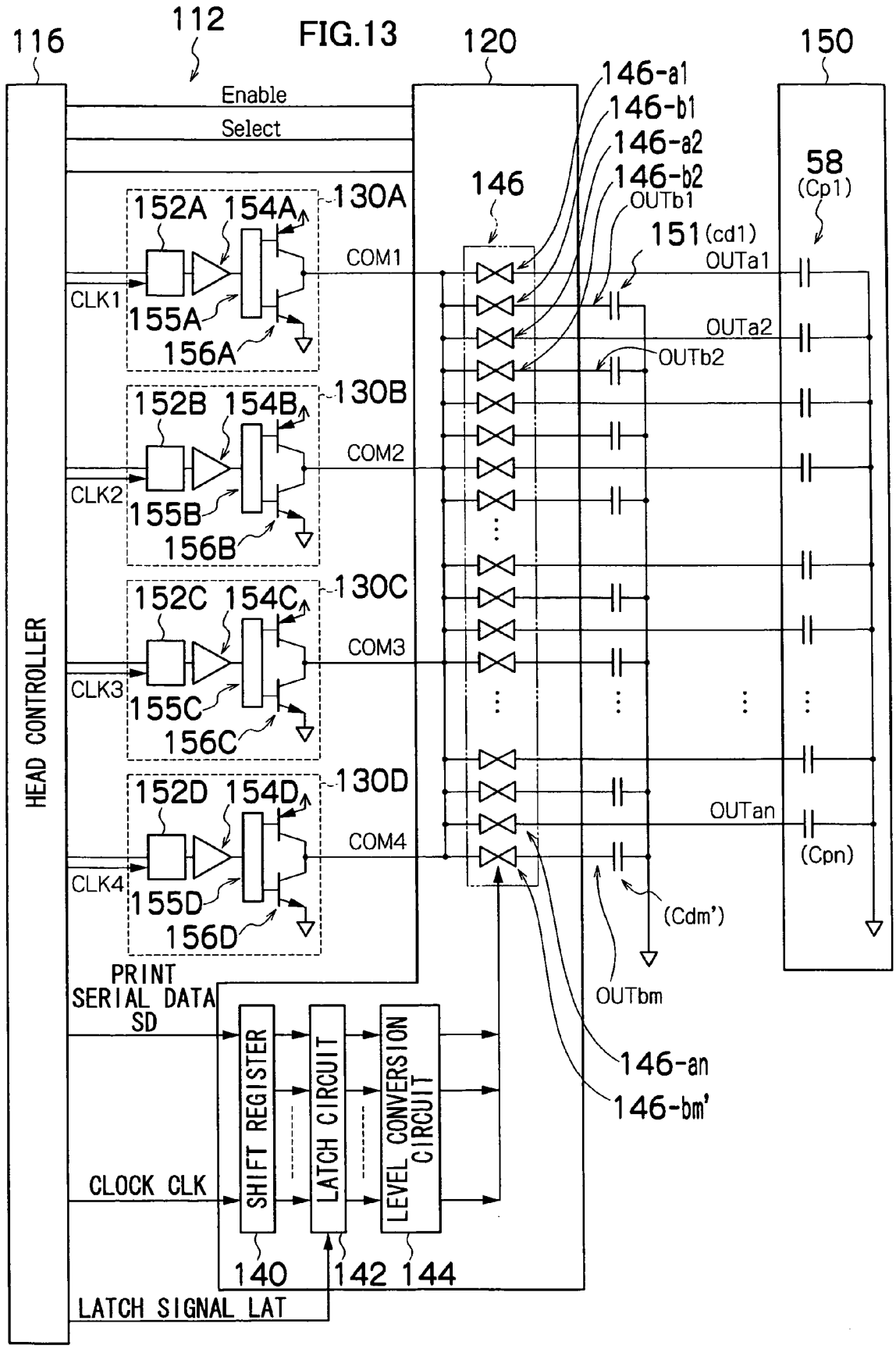
FIG. 13 is a principal schematic drawing showing a further example of the main circuitry relating to head driving in the first embodiment.

FIG. 13 shows a modification example of the principal compositional diagram shown in FIG. 9. In FIG. 13, items which are the same as or similar to those in FIG. 9 are labeled with the same reference numerals and description thereof is omitted here.

As shown in FIG. 13, the elements indicated as capacitive loads together with the reference numerals OUTa1, OUTa2, . . . , OUTan, are the actuators (piezoelectric elements) 58 of the head 50, and the loads indicated by OUTb1, OUTb2, . . . , OUTbm' are the dummy loads 151.

Each of the individual electrodes 57 (the electrodes on the left-hand side in the capacitive loads shown in FIG. 9) corresponding to each of the actuators 58 is connected to a terminal of the corresponding switching elements 146-*ai* (i=1, 2, . . . n;), and the other electrode (common electrode) corresponding to each of the actuators 58 is connected to ground (GND). Furthermore, one electrode (the electrodes on the right-hand side in the capacitive loads shown in FIG. 9) of each of the dummy loads 151 is connected to a terminal of the corresponding switching elements 146-*b*1 to 146-*bj* (j=1, 2, . . . , m'), and the other electrode of each dummy load 151 is connected to ground (GND).

As shown in FIG. 13, the ports "COM1" to "COM4" are connected to the input side terminals of the switching elements 146-*ai* (i=1, 2, . . . , n) and the input side terminals of the switching elements 146-*bj* (=1, 2, . . . , m'). The actuators (piezoelectric elements) 58 of "OUTai" (i=1, 2, . . . , n) are connected to the switching elements 146-*ai* (i=1, 2, . . . , n), and the dummy loads 151 of "OUTbj" (j=1, 2, . . . , m') are connected to the output side terminals of the switching elements 146-*bj* (j=1, 2, . . . , m'), in such a manner that a drive signal can be selectively applied to the actuators (OUTai) and the dummy loads (OUTbj) by controlling the on and off switching of the switching elements 146-*a*1 to 146-*ai* and the switching elements 146-*b*1 to 146-*bj*.

In the mode shown in FIG. 13, the dummy loads 151 connected to each drive waveform generating circuit 130 are increased (in other words, the number of the dummy loads 151 which can be selected according to each drive waveform generating circuit 130 is increased), and selectable types of electrostatic capacitance of the dummy loads 151 are increased.

On the other hand, in the mode shown in FIG. 9, it is possible to reduce the dummy loads 151 installed in the print head 50, in comparison with the mode shown in FIG. 13 where a dummy load 151 is provided for each drive waveform generating circuit 130.

Figure 14:
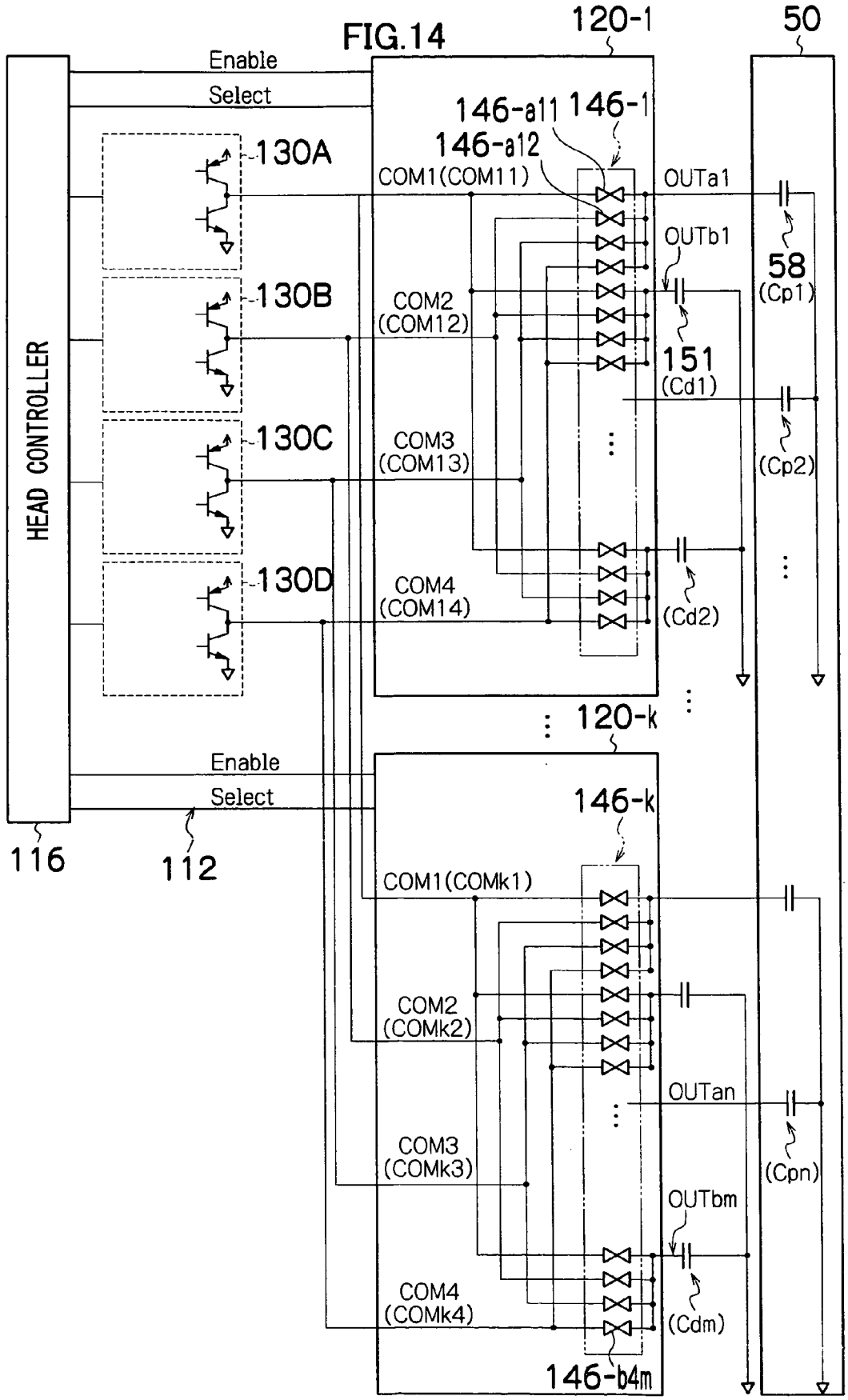
FIG. 14 is a principal schematic drawing showing a further example of the main circuitry relating to the head driving shown in FIG. 9.
Figure 15:
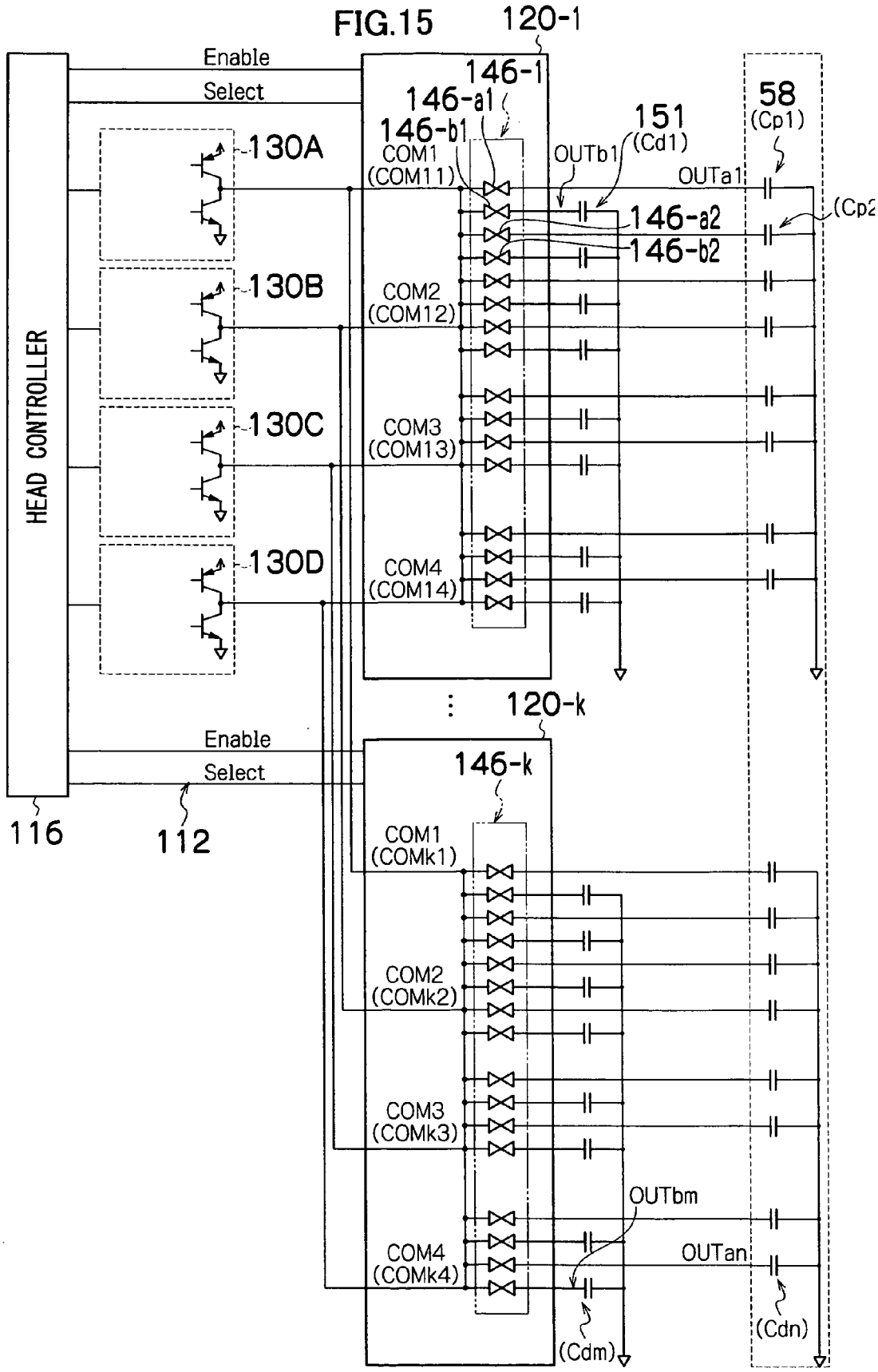
FIG. 15 is a principal schematic drawing showing a further example of the main circuitry relating to the head driving shown in FIG. 14.

FIGS. 14 and 15 show modes where a plurality of (k) switch ICs (120-1 to 120-*k*) are provided. FIG. 14 corresponds to FIG. 9, and FIG. 15 corresponds to FIG. 13. In FIGS. 14 and 15, items which are the same as or similar to those in FIGS. 9 and 13 are labeled with the same reference numerals and description thereof is omitted here. Furthermore, in FIGS. 14 and 15, a portion of the composition shown in FIGS. 9 and 13, such as the waveform generating circuits 152 of the drive circuits 130 and the shift registers 140, are omitted and not illustrated.

If a very large number of nozzles are driven simultaneously, then the heat generated by the on-resistance of the switching elements in the switch ICs 120 may have an adverse effect on the print head 50 (especially, in the periphery of the switch ICs 120). Furthermore, if a very large number of nozzles are simultaneously driven, then the number of dummy loads 151 connected to the drive waveform generating circuits 130 may become redundant, and the drive signals may become concentrated in a particular switch IC under the drive conditions where the number of dummy loads 151 becomes redundant.

In the modes shown in FIGS. 14 and 15, the selection of the actuators 58 and the dummy loads 151 is controlled in such a manner that the generation of heat is not concentrated in one (particular) switch IC 120, by using a plurality of switch ICs 120-1 to 120-*k*.

As shown in FIGS. 14 and 15, the switch ICs 120-1 to 120-*k* are connected in parallel to the drive waveform generating circuits 130. In other words, a composition is adopted in which the "COM1" ports (COM11 to COMk1), the "COM2" ports (COM 12 to COM k2), the "COM3" ports (COM13 to COMk3), and "COM4" ports (COM14 to COMk4) of the switch ICs 120-1 to 120-*k*, are connected to each of the drive waveform generating circuits 130.

Furthermore, in the mode shown in FIG. 15, all of the switching elements of the switch ICs 120-1 to 120-*k* are connected to the drive circuits 130A to 130D, and therefore the selectable range of the dummy loads 151 is increased, and furthermore, the control for dispersing the generation of heat by the switch ICs 120-1 to 120-*k* is facilitated.

FIGS. 14 and 15 show modes where the plurality of switch ICs, each of which has the same number of switching elements, are arranged; however, it is also possible, for example, to provide switch ICs having different numbers of switching elements, functions, specifications, and the like.

Figure 16:
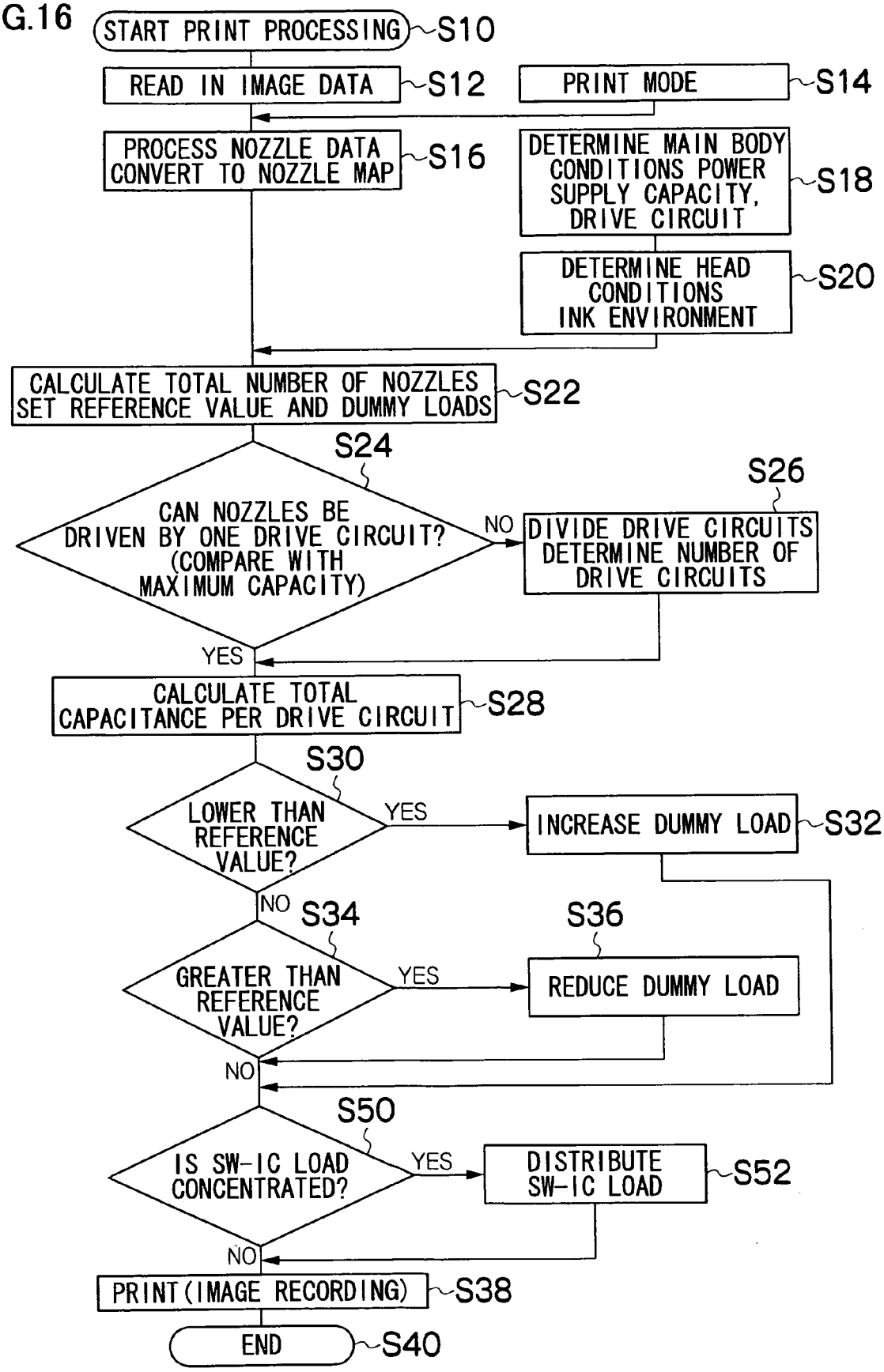
FIG. 16 is a flowchart showing a further example of the dummy load selection control shown in FIG. 12.

FIG. 16 is a flowchart of control for selecting dummy loads 151 using a plurality of switches IC 120-1 to 120-*k*. In FIG. 16, items which are the same as or similar to those in FIG. 12 are labeled with the same reference numerals and description thereof is omitted here.

As shown in FIG. 16, concerning the present example of selection control of the dummy loads 151, which uses a plurality of switch ICs 120-1 to 120-*k*, at step S34 in FIG. 12, if it is determined that the total capacitance determined at step S28 is equal to the reference value (NO at S34), and if, at step S36, the switch ICs 120 has been controlled in such a manner that the load of the default value of the dummy loads 150 or the load of the dummy loads 150 specified at step S32 are reduced, then the procedure advances to step S50.

At step S50, it is determined whether the load is concentrated in (one) particular switch IC 120 or not (whether the load driven by one switch IC exceeds a prescribed value or not). If it is determined that the load is concentrated in a particular switch IC 120 (YES at S50), then the selection of the actuators 58 and the dummy loads 151 is controlled in such a manner that the load is distributed to a plurality of switch ICs 120 (S52), and the procedure advances to step S38, where printing is carried out.

On the other hand, if it is determined at step S50 that the load is not concentrated in a particular switch IC 120 (NO at S50), then the procedure advances directly to step S38, and printing is carried out.

Moreover, if it is determined at step S34 that the total capacitance determined at step S28 is smaller than the reference value (NO at S34), then the procedure advances to step S50, and it is determined whether the load is concentrated in a particular switch IC 120 or not.

In this way, if control is applied in such a manner that the load is distributed among a plurality of switch ICs, rather than concentrating the load in a particular switch IC 120, then it is possible to prevent breakdown of the switch ICs 120, and the heat radiators provided in the switch ICs 120 can be reduced in size. Furthermore, since the switch ICs 120 are controlled in such a manner that they drive the load within a prescribed range, then the operating margins of the switch ICs 120 are not redundant, and the switch ICs 120 and the peripheral circuits thereof can be reduced in size.

Second Embodiment

Next, a dummy load selection control method relating to a second embodiment according to the present invention is described below. In the present embodiment, the selection of the dummy loads 151 is controlled in such a manner that the total capacitance of the capacitive load of the actuators 58 and the dummy loads 151 falls within a prescribed reference capacitance range.

Figure 17:
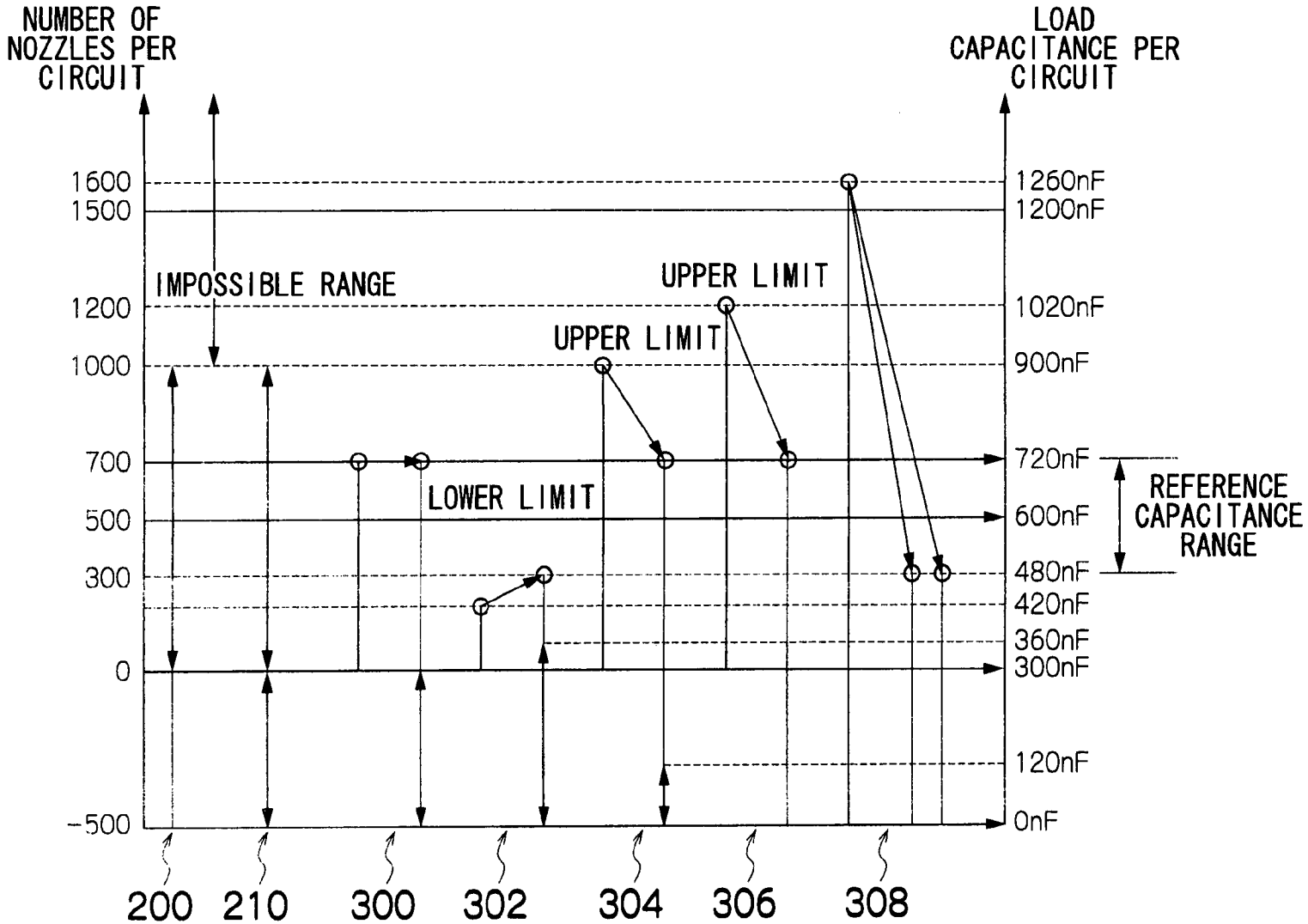
FIG. 17 is a diagram showing dummy load selection control relating to a second embodiment of the present invention.

FIG. 17 is a diagram which describes the control of dummy load selection relating to this second embodiment. In FIG. 17, items which are the same as or similar to those in FIG. 12 are labeled with the same reference numerals and description thereof is omitted here.

If the number of drive nozzles is 700 nozzles, as indicated by reference numeral 300 in FIG. 17, then the total capacitance, when the dummy loads 151 are set to a default value of 300 nF, is 720 nF, which is the upper limit of the reference capacitance range (where the capacitive load of the actuators 58 is 420 nF: 720 nF−300 nF=420 nF). Therefore, the load value of the dummy loads 151 are set to the default value of 300 nF.

Furthermore, if the number of driven nozzles is 200, as indicated by reference numeral 302, then the total capacitance becomes 420 nF when the dummy loads 151 are set to a default of 300 nF (the capacitive load of the actuators 58 is 120 nF: 420 nF−300 nF=120 nF). This is lower than the bottom limit of the reference capacitance range of 480 nF. Consequently, the load value of the dummy loads 151 is set to a value of 360 nF (=480 nF−(420 nF−300 nF)) in such a manner that the total capacitance is the lower limit of the reference capacitance range, namely, 480 nF.

On the other hand, if the number of driven nozzles is 1000 (the maximum number of nozzles for one drive waveform generating circuit 130), as indicated by reference numeral 304, then the total capacitance is 900 nF when the dummy loads 151 are set to a default of 300 nF (the capacitive load of the actuators 58 is 600 nF: 900 nF−300 nF=600 nF). This is higher than 720 nF of the upper limit of the reference capacitance range. Consequently, the load value of the dummy load 151 is set to a value of 120 nF (=720 nF−(900 nF−300 nF)) in such a manner that the total capacitance is the upper limit of the reference capacitance range, namely, 720 nF.

Furthermore, if the number of driven nozzles is 1200 (exceeding the drive capacitance of one drive waveform generating circuit 130), as indicated by reference numeral 306, then the total capacitance when the dummy loads 151 are set to a default of 300 nF is 1020 nF (the capacitive load of the actuators 58 is 720 nF: 1020 nF−300 nF=720 nF), and therefore the capacitive load of the actuators 58 is equal to the upper limit of the reference capacitance range, and the load value of the dummy loads 151 is set to a value of 0 nF (=720 nF−(1020 nF−300 nF)).

In other words, the total capacitance which is the sum of the capacitive load of the actuators 58 and the default value (300 nF) of the dummy loads is determined. If this total capacitance lies outside a previously established reference capacitance range (480 nF to 720 nF), then the selection of the dummy loads 151 is controlled in such a manner that the total capacitance is either the upper limit or the lower limit of the reference capacitance range.

In the example shown in FIG. 17, if the total capacitance exceeds the upper limit of the reference capacitance range, then the dummy loads 151 are selected in such a manner that the total capacitance becomes the upper limit of the reference capacitance range. In contrast, if the total capacitance is less than the lower limit of the reference capacitance range, then the dummy loads 151 are selected in such a manner that the total capacitance becomes the lower limit of the reference capacitance range.

As indicated by reference numeral 308, if the total capacitance exceeds the reference capacitance range and the dummy loss is set to 0 nF, then control is implemented in such a manner that a plurality of drive waveform generating circuits 130 are used. In this case, a large number of nozzles are driven. Thus, if the dummy loads are selected in such a manner that the total capacitance becomes the lower limit of the reference capacitance range, then the power consumption of the switch IC 120 and the drive waveform generating circuit 130 is distributed. Such a case is desirable because heat generation is prevented from being concentrated in a particular switch IC 120 and a particular drive waveform generating circuit 130.

In the example indicated by reference numeral 308 in FIG. 17, the number of driven nozzles is 1600 nozzles. If the dummy loads 151 are set to a default of 300 nF, then the total capacitance is 1260 nF. Even if the dummy load is set to 0 nF, then the total capacitance is 960 nF, which exceeds the drive capacity of one drive waveform generating circuit 130. Consequently, the switch IC 120 is controlled in such a manner that this total capacitance is divided in two portions, and the drive nozzles (1600 nozzles) are driven by using two drive waveform generating circuits 130. Furthermore, the dummy loads 151 are selected in such a manner that the total capacitance corresponding to each of the drive waveform generating circuits 130 becomes 480 nF, which is the lower limit of the reference capacitance range. In this example, the load value of the dummy load 151 is a value of 0 nF (=(960 nF/2)−480 nF).

Figure 18:
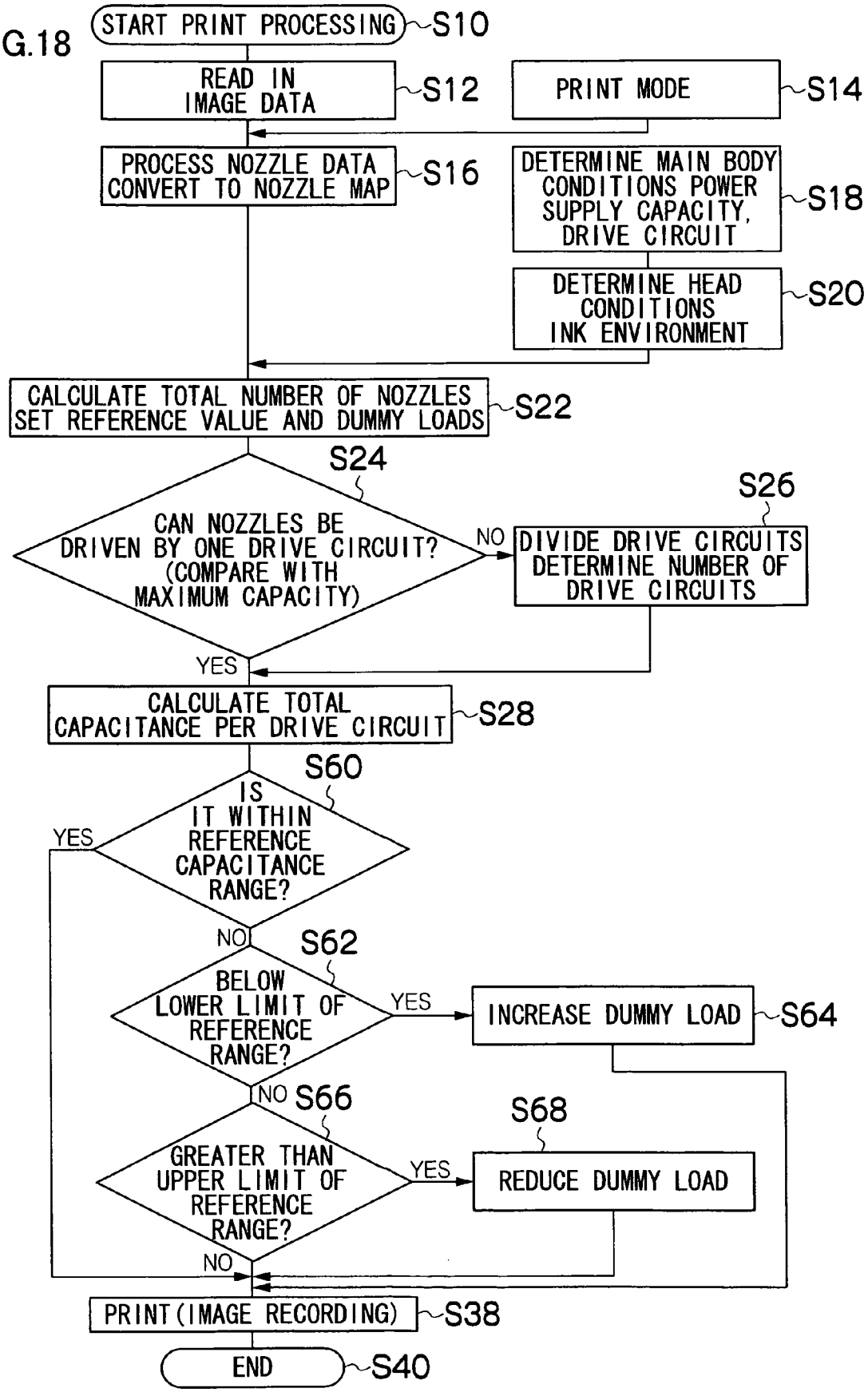
FIG. 18 is a flowchart showing a sequence of dummy load selection control relating to the second embodiment.
Figure 19:
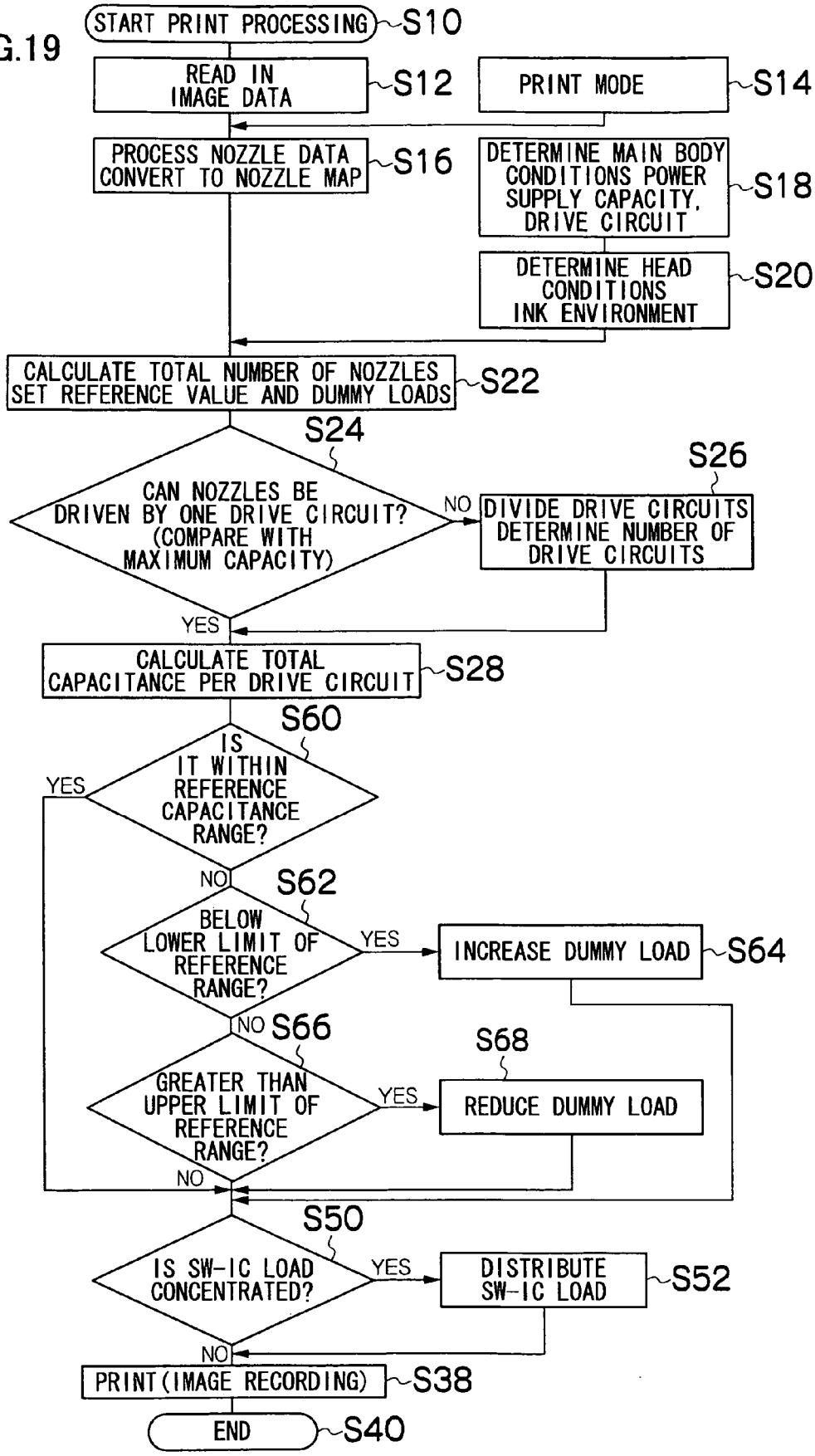
FIG. 19 is a flowchart showing a further example of the dummy load selection control shown in FIG. 18.

FIGS. 18 and 19 show a flowchart of controlling the selection of the dummy loads 151 shown in FIG. 17. FIG. 18 corresponds to FIG. 12 showing the first embodiment described above, and FIG. 19 corresponds to FIG. 16 showing the first embodiment.

In the control example shown in FIG. 18, at step S28, if the total capacitance to be driven by one drive waveform generating circuit 130 has been determined, then the procedure advances to step S60.

At step S60, it is determined whether the total capacitance determined at step S28 is within the reference capacitance range or not. If the total capacitance is determined to be outside the reference capacitance range (NO at S60), then the procedure advances to step S62, and then it is determined whether the total capacitance is below the lower limit of the reference capacitance range or not.

At step S62, if it is determined that the total capacitance is below the lower limit of the reference capacitance range (YES at S62), then the dummy loads 151 are increased from the default value in such a manner that the load value of the dummy loads 151 is the lower limit value of the reference capacitance range (S64), and the procedure then advances to step S38.

On the other hand, if it is determined that the total capacitance is greater than the lower limit of the reference capacitance range (NO at S62), and the procedure advances to step S66, where it is determined whether the total capacitance is greater than the upper limit of the reference capacitance range or not. If it is determined that the total capacitance is greater than the upper limit of the reference capacitance range (YES at S66), then the dummy loads 151 are reduced (S68) in such a manner that the load value of the dummy loads 151 are the upper limit (or lower limit) value of the reference capacitance range, whereupon the procedure advances to step S38.

Furthermore, in the flowchart shown in FIG. 19, if processing has been implemented at step S64 in FIG. 18 in order to increase the dummy loads 151 in such a manner that the total capacitance is the lower limit of the reference capacitance range, then the procedure advances to step S50, where it is determined whether the load has been concentrated in a particular switch IC 120 or not.

Moreover, if it is determined at step S66 that the total capacitance has reached the upper limit of the reference capacitance range (NO at S66), or if processing is implemented at step S68 in order to reduce the dummy load 151 in such a manner that the total capacitance is the upper limit value of the reference capacitance range, then the procedure advances to step S50.

As described above, by selecting the dummy loads 151 in such a manner that the total capacitance, given by the sum of the capacitive load of the actuators 58 involved in ejection and the dummy loads 151, falls within a prescribed range (a range of capacitive load in which ink ejection can be performed without any quality problems in the recorded image), it is possible to flexibly perform the control and a reduced control burden can be expected.

Moreover, selecting the dummy loads 151 in such a manner that the total capacitance is the lower limit of the reference capacitance range helps to reduce power consumption. Furthermore, selecting the dummy loads 151 in such a manner that the total capacitance is the upper limit of the reference capacitance range, makes it possible to increase the load which can be driven by one drive waveform generating circuit 130 (the number of nozzles which can be driven by one drive waveform generating circuit 130), without redundant use of the dummy loads 151.

Third Embodiment

Next, a third embodiment according to the present invention is described with reference to FIG. 20 and FIG. 21. In the dummy load selection control in the present embodiment, if the total capacitance is within a reference load capacitance range, and if the total capacitance can be set to the lower limit of the reference capacitance range, then the dummy loads 151 are selected in such a manner that the total capacitance becomes the lower limit of the reference capacitance range. In the third embodiment, items which are the same as or similar to those in the first or second embodiment described above are labeled with the same reference numerals and description thereof is omitted here.

Figure 20:
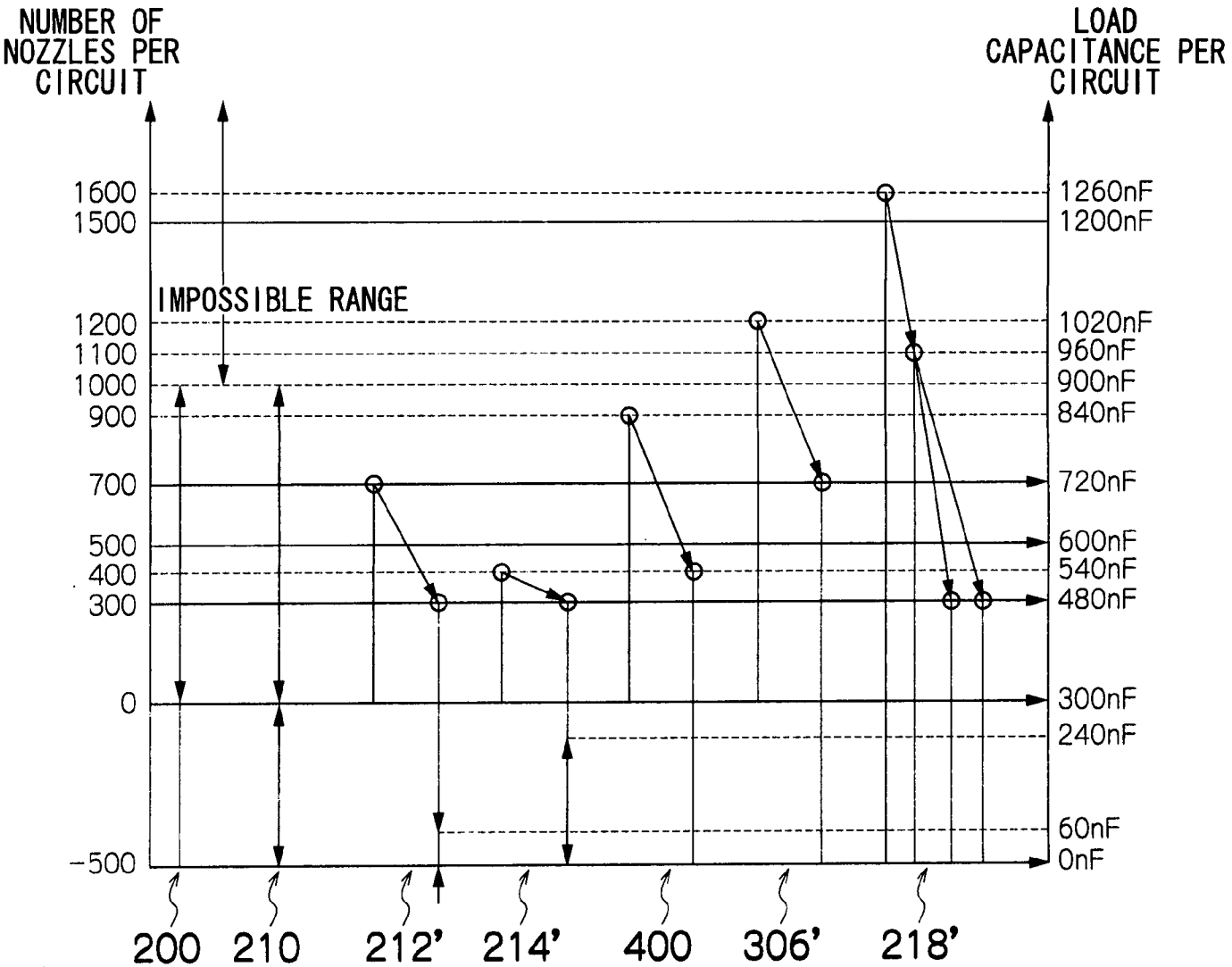
FIG. 20 is a diagram showing dummy load selection control relating to a third embodiment of the present invention.

In the example indicated by reference numeral 212' in FIG. 20, the number of driven nozzles is 700 nozzles, and if the dummy loads 151 are set to a default of 300 nF, then the total capacitance is 720 nF. Consequently, the load value of the dummy loads 151 is set to a value of 60 nF (=300 nF−(720 nF−480 nF)) in such a manner that the total capacitance is the lower limit of the reference capacitance range, namely, 300 nF.

In the example indicated by reference numeral 214', the number of driven nozzles is 400 nozzles, and if the dummy loads 151 are set to a default of 300 nF, then the total capacitance is 540 nF. Consequently, the load value of the dummy loads 151 is set to a value of 240 nF (=300 nF−(540 nF−480 nF)) in such a manner that the total capacitance is the lower limit of the reference capacitance range, namely, 300 nF.

In the example indicated by reference numeral 400, the number of driven nozzles is 900 nozzles, and if the dummy loads 151 are set to a default of 300 nF, then the total capacitance is 840 nF. In a case of this kind, even if the load value of the dummy loads 151 is set to 0 nF, the total capacitance is 540 nF, which is greater than the lower limit of the reference capacitance range. However, provided that the total capacitance is equal to or lower than the upper limit of the reference capacitance range, namely, 720 nF (provided that the total capacitance is within the reference capacitance range), then the load value of the dummy loads 151 is set to a value of 0 nF.

In the example indicated by reference numeral 316', the number of driven nozzles is 1200 nozzles, and if the dummy loads 151 are set to a default of 300 nF, then the total capacitance is 1020 nF. In this case, even if the load value of the dummy loads 151 is set to 0 nF, the total capacitance is 720 nF, which is greater than the lower limit of the reference capacitance range. However, since the total capacitance is equal to or lower than the upper limit of the reference capacitance range (since the total capacitance is the same as the upper limit of the reference capacitance range), then the load value of the dummy loads 151 is set to a value of 0 nF.

In the example indicated by reference numeral 218', the number of driven nozzles is 1600 nozzles, and if the dummy loads 151 are set to a default of 300 nF, then the total capacitance is 1260 nF. Even if the load value of the dummy loads 151 is set to 0 nF, the total capacitance is 960 nF, which exceeds the drive capacity of one drive waveform generating circuit 130. Consequently, the switch IC 120 is controlled in such a manner that this total capacitance is divided into two parts, and the drive nozzles (1600 nozzles) are driven by using the two drive waveform generating circuits 130.

Furthermore, the dummy loads 151 are selected in such a manner that the total capacitance corresponding to the drive waveform generating circuits 130 becomes 480 nF, which is the lower limit of the reference capacitance range. In this example, the load value of the dummy loads 151 is set to a value of 0 nF (=(960 nF/2)−480 nF).

Figure 21:
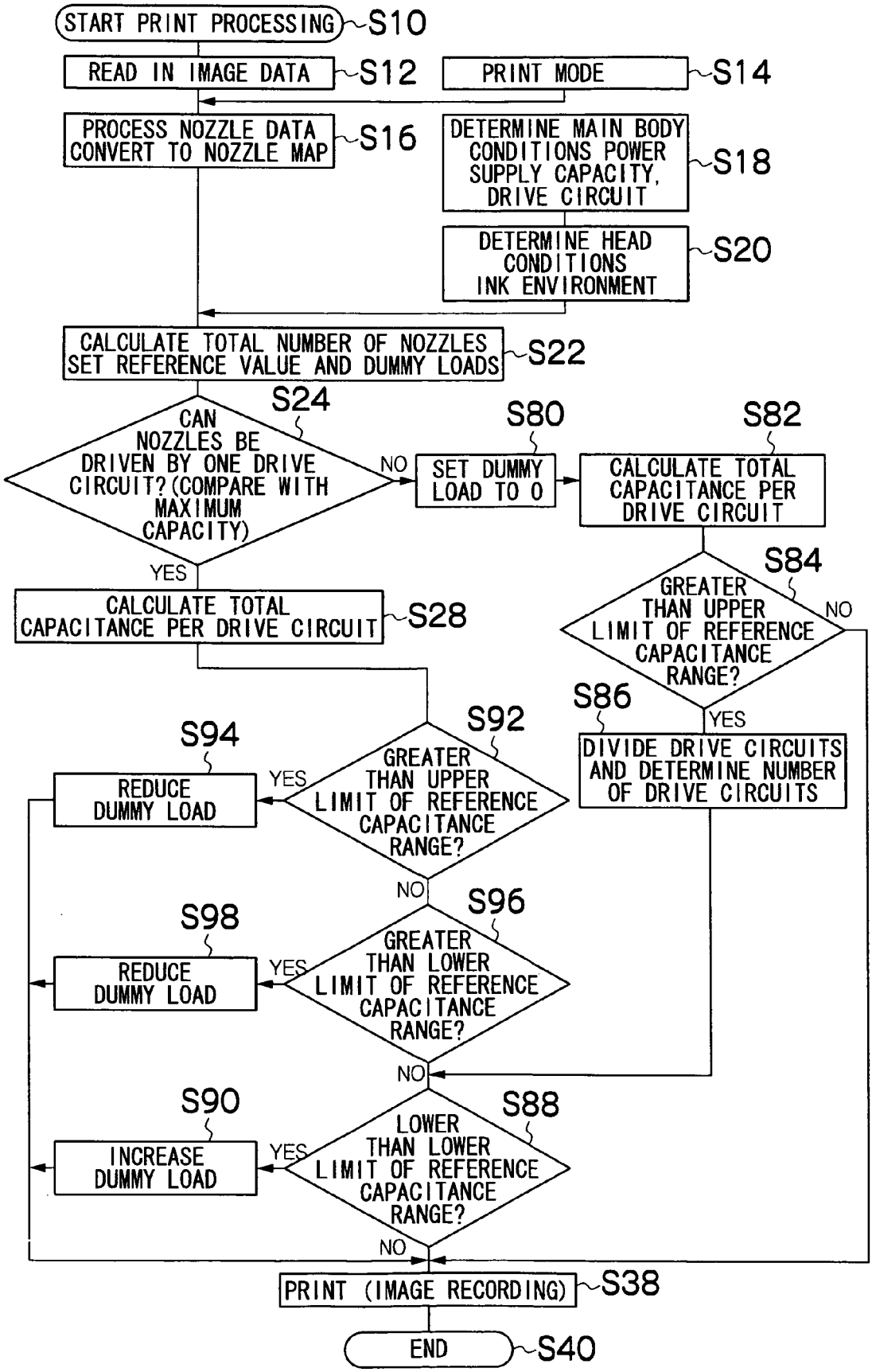
FIG. 21 is a flowchart showing a sequence of dummy load selection control relating to the third embodiment.

FIG. 21 is a flowchart of the present control sequence. As shown in FIG. 21, at step S24, it is determined whether the total number of nozzles determined at step S22 can be driven by one drive waveform generating circuit 130 or not. If it is determined that that number of nozzles cannot be driven by one drive circuit 130 (NO at S24), then a value of 0 nF is selected for the dummy loads 151 (S80) and the total capacitance at the dummy load 151 of 0 nF is determined (S82).

Thereupon, it is determined whether the total capacitance with the dummy loads 151 of 0 nF is greater than the upper limit of the reference capacitance range or not (S84). If the total capacitance is lower than the upper limit of the reference capacitance range when the load value of the dummy loads 151 is 0 nF (NO at S84), then the procedure advances to step S38 and printing is carried out.

On the other hand, if the total capacitance with the dummy loads 151 of 0 nF is greater than the upper limit of the reference capacitance range (YES at S84), then the total number of nozzles determined at step S22 is divided up, and the number of the drive waveform generating circuits 130 for driving this total number of nozzles is determined (S86), whereupon the procedure advances to step S88.

At step S88, it is determined whether the total capacitance corresponding to each drive circuit 130 (after dividing the total number of nozzles) is less than the lower limit of the reference capacitance range or not. If the total capacitances corresponding to the drive circuits 130 are equal to or greater than the lower limit of the reference capacitance range (NO at S88), then the procedure advances to step S38 and printing is carried out.

On the other hand, if, at step S88, the total capacitances corresponding to the drive circuits are less than the lower limit of the reference capacitance range (YES at S88), then the dummy loads 151 are increased, and dummy loads 151 are selected in such a manner that the total capacitances corresponding to each of the drive circuits 130 is the lower limit value of the reference capacitance range (S90).

Furthermore, if it is determined at step S24 that the number of nozzles can be driven by one drive circuit 130 (YES at S24), then the procedure advances to step S28. At S28, the total capacitance corresponding to the one drive waveform generating circuit 130 is determined, whereupon the procedure advances to step S92.

At step S92, it is determined whether the total capacitance determined at step S28 exceeds the upper limit of the reference capacitance range or not. If the total capacitance is equal to or greater than the reference capacitance range (YES at S92), then the dummy loads 151 are reduced, and the dummy loads 151 are selected so that the total capacitance becomes the lower limit value of the reference capacitance range (S94), whereupon the procedure advances to step S38 and printing is carried out. At step S92, when the total capacitance exceeds the lower limit of the reference capacitance range even if a value of 0 nF is selected for the dummy loads 151, then 0 nF is selected for the dummy loads 151.

On the other hand, if, at step S92, it is determined that the total capacitance is equal to or lower than the upper limit of the reference capacitance range (NO at S92), then it is determined whether this total capacitance is equal to or greater than the lower limit of the reference capacitance range or not (S96).

At step S96, if it is determined that the total capacitance exceeds the lower limit of the reference capacitance range (YES at S96), then the load value of the dummy loads 151 is reduced and the dummy loads 151 which cause the total capacitance to be the lower limit of the reference capacitance range is selected (S98).

On the other hand, if, at step S96, it is determined that the total capacitance is equal to or less than the lower limit of the reference capacitance range (NO at S96), then the procedure advances to step S88.

As described above, the dummy loads 151 are selected in such a manner that the total capacitance, which is the sum of the capacitive load of the actuators 58 involved in ejection and the dummy loads 151 not involved in ejection, is the lower limit of the reference capacitance range. Thus, low power consumption can be achieved in the switch IC 120, the drive waveform generating circuits 130 and the peripheral circuits thereof. Moreover, reduction in the scale of the circuitry can be expected, due to size reductions in the power supply which supplies power to these elements (for example, power supply such as a switching power supply), size reductions in the switch IC 120, and size reductions in drive waveform generating circuits 130.

Furthermore, when the total capacitance exceeds the load capacitance of one drive waveform generating circuit even if the dummy loads 151 are set to 0 nF, then control is implemented in such a manner that a plurality of drive waveform generating circuits 130 are used. When the total capacitance is within the reference capacitance range but exceeds the lower limit of the reference capacitance range even if the dummy loads 151 are set to 0 nF, then a value of 0 nF is selected for the dummy loads 151. Therefore, it is possible to reduce power consumption to a certain degree.

In the present example, a composition is adopted in which the dummy loads 151 are selected in such a manner that the total capacitance becomes the lower limit of the reference capacitance range. However, as shown in FIG. 22, it is also possible to select the dummy loads 151 in such a manner that the total capacitance becomes the upper limit of the reference capacitance range.

Figure 22:
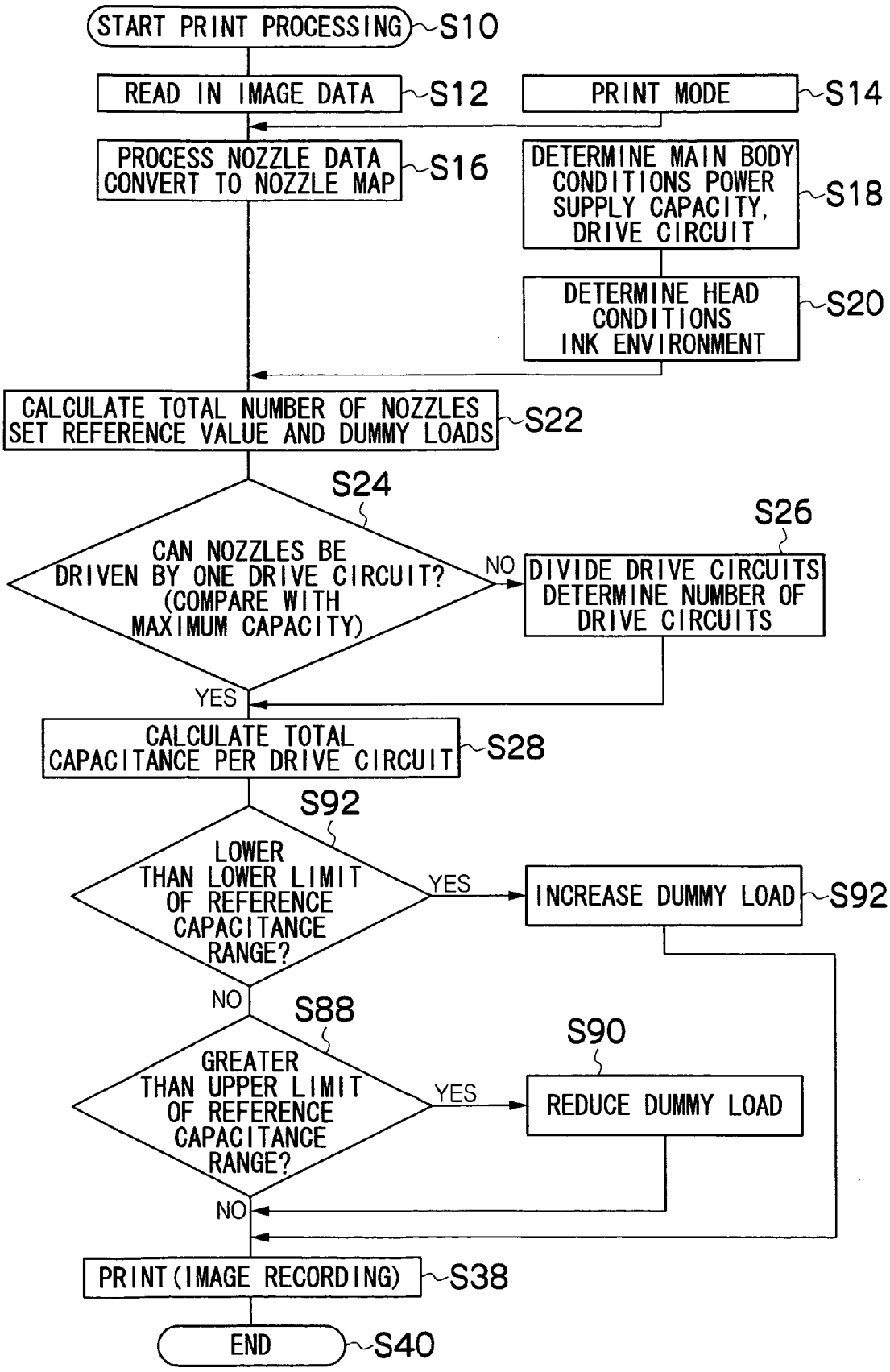
FIG. 22 is a flowchart showing a further mode of the dummy load selection control shown in FIG. 21.

In the flowchart shown in FIG. 22, when the total capacitance is determined at step S28, the procedure advances to step S92 and it is determined whether the total capacitance exceeds the upper limit of the reference capacitance range or not. If the total capacitance exceeds the upper limit of the reference capacitance range (YES at S92), then the load value of the dummy loads 151 is reduced, and dummy loads 151 which cause the total capacitance to be the upper limit of the reference capacitance range is selected (S94).

On the other hand, if, at step S92, it is determined that the total capacitance is equal to or lower than the upper limit of the reference capacitance range (NO at S92), then it is determined whether this total capacitance is below the lower limit of the reference capacitance range or not (S88).

At step S88, if it is determined that the total capacitance is below the lower limit of the reference capacitance range (YES at S88), then the load of the dummy loads 151 is increased and dummy loads 151 which cause the total capacitance to be the upper limit value of the reference capacitance range is selected (S90).

On the other hand, if, at step S88, the total capacitance is equal to or greater than the lower limit of the reference capacitance range (NO at S88), then the procedure advances to step S38 and printing is carried out.

With a composition which selects the dummy loads 151 in such a manner that the total capacitance is the upper limit value of the reference capacitance range in this way, it is possible to drive a number of actuators 58 corresponding to the reduction in the dummy loads 151. Furthermore, the number of dummy loads 151 can be reduced in such a manner that they are not used redundantly, and the power consumed by the dummy loads 151 can be reduced, thereby enabling size reductions in the circuitry of the switch IC 120, the drive waveform generating circuits 130, the power supply which supplies power to these elements, and the like.

Figure 23A:
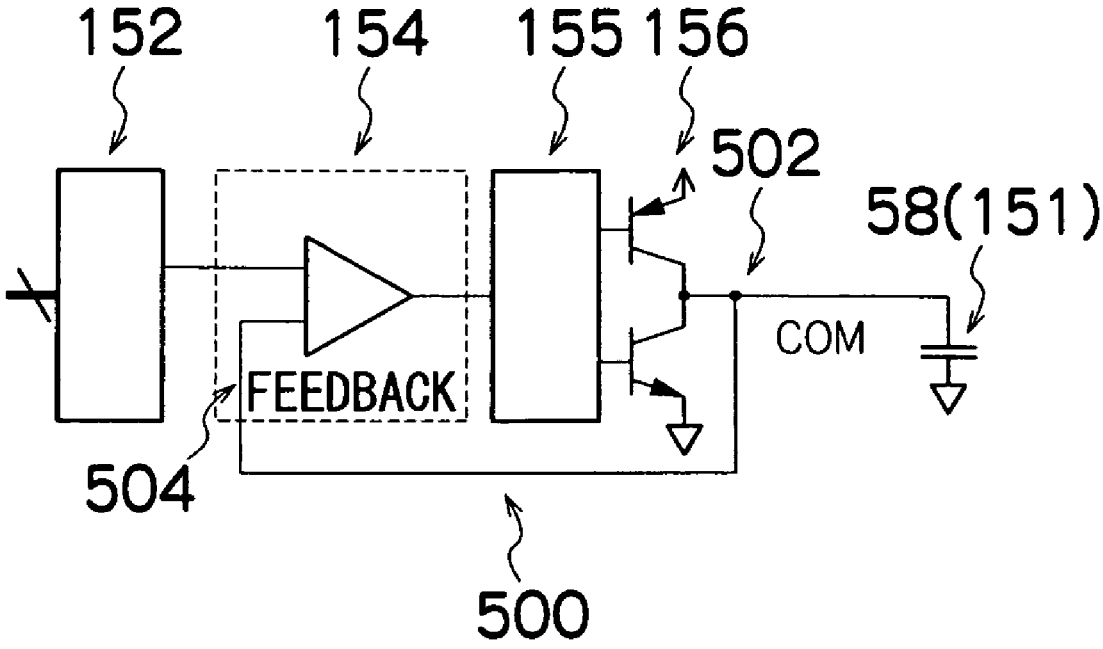
FIGS. 23A and 23B are diagrams illustrating a circuit having feedback.
Figure 23B:
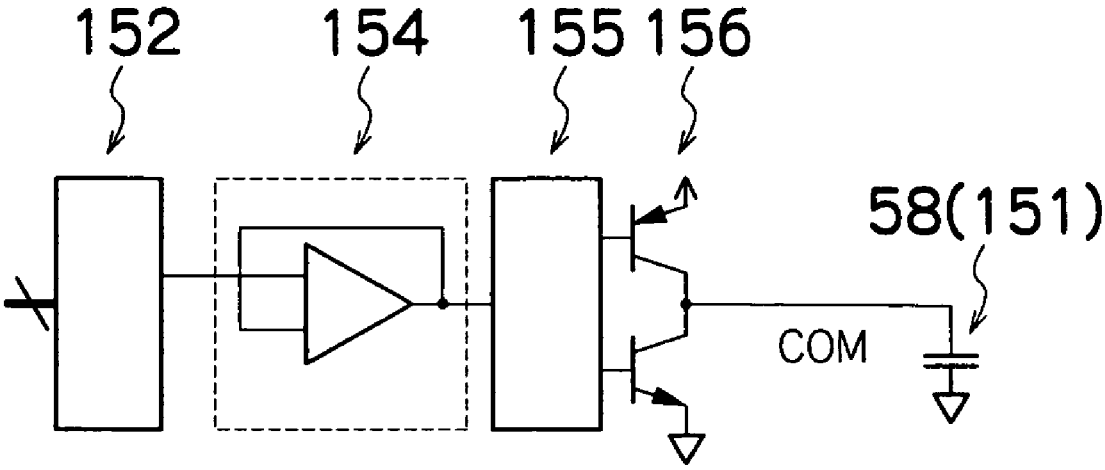
Figure 24:
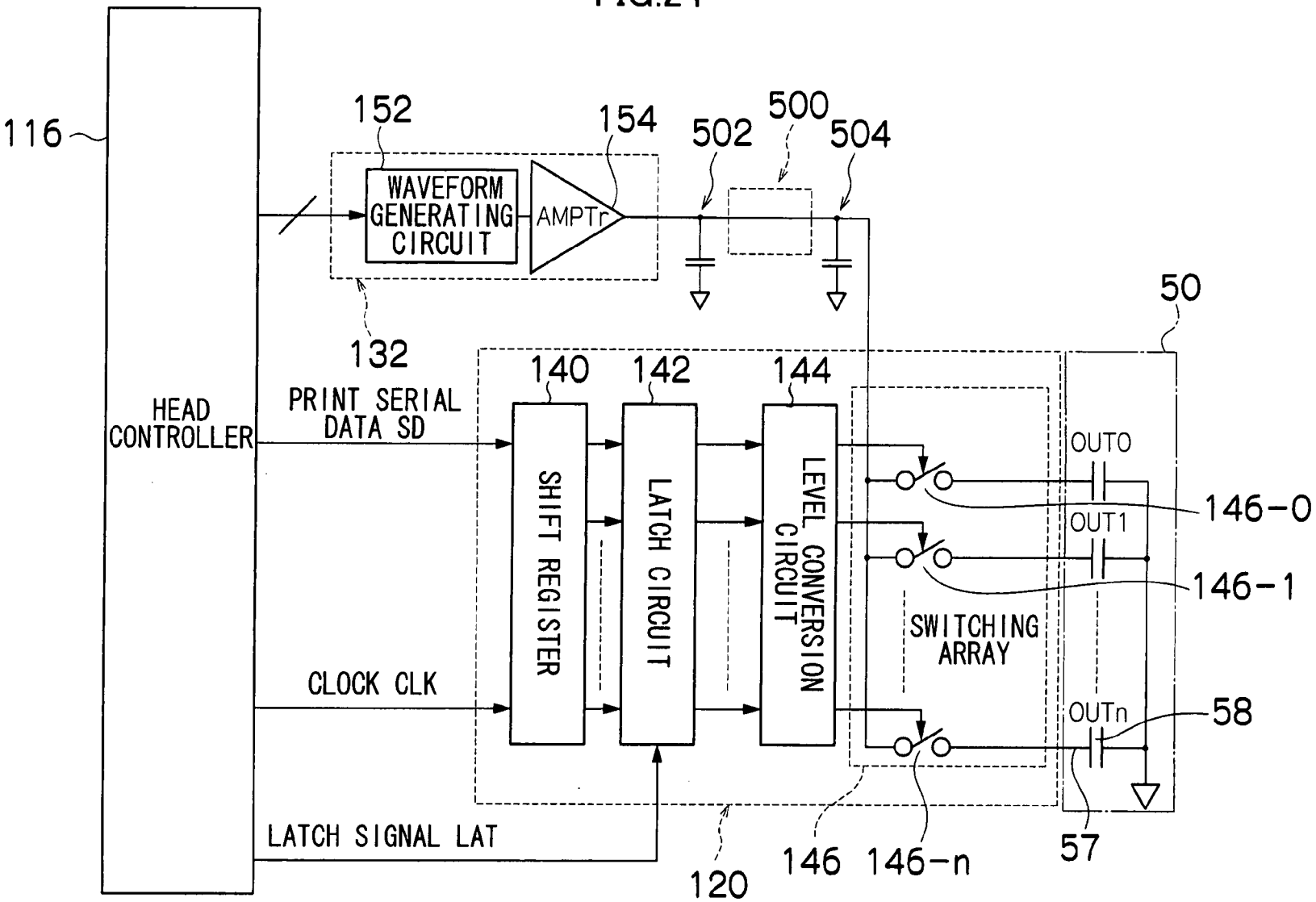
FIG. 24 is a principal schematic drawing of the main circuitry relating to head driving of an inkjet recording apparatus relating to the related art.

If a common drive waveform (the multiple-value drive waveform shown in FIGS. 10A to 10E) is adopted for the drive signal, then a circuit having hardware feedback such as that shown in FIG. 23A is generally used.

FIG. 23A shows one example of a feedback circuit 500. The feedback circuit 500 shown in FIG. 23A is composed in such a manner that feedback is applied from the output terminal 502 of the drive waveform generating circuit 130 connected to the COM port of the switch IC 120, to the input section 504 of the amplifier circuit 154.

It is not necessary to use a multiple-value drive waveform of this kind for the drive signal that is applied to the dummy loads 151. If the slight vibration waveform 161 as shown in FIG. 10B, or the like, is adopted, then a circuit which does not apply a hardware feedback such as 23B (a circuit which is equivalent to the circuit in FIG. 23A free of the feedback circuit 500) can be used, thus making it possible to simplify the circuit composition.

Furthermore, the various types of analysis, determination and calculation in the aforementioned flowchart may be carried out by means of a CPU or image processing LSI installed in the inkjet recording apparatus 10. They may be carried out by the host computer 86. The processing may be shared among these devices.

If it is possible to reduce the drive current per drive waveform generating circuit 130, then not only does this increase the range of selection of the transistors to be used in the power amplifier section, and the like, but it also allows the possibility of using transistors capable of high-speed switching which is an important characteristic in waveform generation. The number of drive circuits can be designed suitably in accordance with various factors, such as the number of actuators, the ejection performance, the circuit size, costs, and the like.

The aforementioned embodiments are described with respect to an inkjet recording apparatus used for color printing by means of a plurality of colors of ink; however, the present invention may also be applied to an inkjet recording apparatus used for monochrome printing.

Moreover, in the foregoing explanation, an inkjet recording apparatus is described as one example of an image forming apparatus, but the scope of application of the present invention is not limited to this. For example, the drive apparatus of a liquid ejection head, and the liquid ejection apparatus according to the present invention may also be applied to a photographic image forming apparatus in which developing solution is applied to a printing paper by means of a non-contact method. Furthermore, the scope of application of the driving apparatus for the liquid ejection head and the liquid ejection apparatus according to the present invention is not limited to an image forming apparatus. The present invention may also be applied to various other types of apparatuses which can spray treatment liquid or other liquid by means of a liquid ejection head toward a liquid received medium (e.g. a coating device, wiring pattern printing device, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a liquid ejection head which has a plurality of nozzles and a plurality of pressure generating elements corresponding to the nozzles, and applies drive signals to the pressure generating elements so as to eject recording liquid from the nozzles in accordance with image data;

a plurality of drive waveform generating circuits which are connected to the pressure generating elements and generate the drive signals having an identical waveform for driving the pressure generating elements;

a plurality of dummy capacitive loads which are connected to the drive waveform generating circuits;

a circuit selection device which selects at least one of the drive waveform generating circuits for applying the drive signals to at least one of the pressure generating elements and the dummy capacitive loads; and a circuit selection control device which sets a reference load capacitance for each of the drive waveform generating circuits, calculates a total number of the pressure generating elements to be simultaneously driven to eject the recording liquid in accordance with the image data, and determines whether a total load capacitance corresponding to the total number of the pressure generating elements to be simultaneously driven is larger than the reference load capacitance, when the total load capacitance is not larger than the reference load capacitance, the wherein;

when the total load capacitance is not larger than the reference load capacitance, the circuit selection control device sets one of the drive waveform generating circuits to be used to drive the total number of the pressure generating elements to be simultaneously driven, and sets a dummy capacitance that is a sum of at least one of the dummy capacitive loads to be connected to the one of the drive waveform generating circuits so that a sum capacitive load of the dummy capacitance and the total load capacitance is equal to the reference load capacitance;

when the total load capacitance is larger than the reference load capacitance, the circuit selection control device sets at least two of the drive waveform generating circuits to be used to drive the total number of the pressure generating elements to be simultaneously driven, and sets, with respect to each of the at least two of the drive waveform generating circuits which are set to be used, a dummy capacitance that is a sum of at least one of the dummy capacitance loads to be connected to said each of the at least two of the drive waveform generating circuits so that a sum capacitance of the dummy capacitance and a load capacitance corresponding to the pressure generating elements to be simultaneously driven by said each of the at least two of the drive waveform generating circuits is equal to the reference load capacitance; and.

2. The image forming apparatus as defined in claim 1, wherein the circuit selection control device controls the circuit selection device in such a manner that total of the electrostatic capacitance of the at least one of the pressure generating elements and electrostatic capacitance of the at least one of the dummy capacitance loads which are connected to the at least one of the drive waveform generating circuits, falls within a prescribed range.

3. The image forming apparatus as defined in claim 1, wherein a plurality of the circuit selection devices are provided.

4. The image forming apparatus as defined in claim 3, wherein the circuit selection control device controls the circuit selection devices in such a manner that total of electrostatic capacitance of the at least one of the pressure generating elements and electrostatic capacitance of the at least one of the dummy capacitive loads which are connected to each of the circuit selection devices, falls within a prescribed range.

5. The image forming apparatus as defined in claim 3, wherein the circuit selection control device controls the circuit selection devices in such a manner that total of electrostatic capacitance of the at least one of the pressure generating elements and electrostatic capacitance of the at least one of the dummy capacitive loads which are connected to each of the circuit selection devices, becomes a prescribed value.

6. The image forming apparatus as defined in claim 1, wherein electrostatic capacitance of at least one of the dummy capacitive loads is different from electrostatic capacitance of other of the dummy capacitive loads.

7. The image forming apparatus as defined in claim 1, wherein the reference load capacitance is set to be a half of a maximum drive capacity of each of the drive waveform generating circuits.

8. The image forming apparatus as defined in claim 1, wherein the circuit selection control device sets an initial value of the dummy capacitance when calculating the total number of the pressure generating elements to be simultaneously driven in accordance with the image data, and then adjusts the dummy capacitance from the initial value so that the sum capacitance is equal to the reference load capacitance.

9. The image forming apparatus as define in claim 1, wherein the plurality of dummy capacitance loads include ceramic capacitors.

10. The image forming apparatus as define in claim 1, wherein the plurality of dummy capacitance loads include pressure generating elements which are arranged in the liquid ejection head and have characteristics identical with the pressure generating elements corresponding to the nozzles.

11. The image forming apparatus as define in claim 1, wherein the reference load capacitance is set to be a middle value of a drive capacity range of each of the drive waveform generating circuits.

* * * * *